US012723428B2

(12) United States Patent
Livacich et al.

(10) Patent No.: US 12,723,428 B2
(45) **Date of Patent: *Sep. 1, 2026**

(54) MODULAR SYSTEM INCLUDING SHAFT SEGMENTS HAVING CONFIGURATION AND BREAKDOWN ATTACHMENTS

(71) Applicants: John Livacich, Sunnyvale, CA (US); Kendyl A. Román, Sunnyvale, CA (US)

(72) Inventors: John Livacich, Sunnyvale, CA (US); Kendyl A. Román, Sunnyvale, CA (US)

(73) Assignee: Evrio, Inc., Santa Clara, CA (US)

( * ) Notice: Subject to any disclaimer, the term of this patent is extended or adjusted under 35 U.S.C. 154(b) by 1338 days.

This patent is subject to a terminal disclaimer.

(21) Appl. No.: 14/318,638

(22) Filed: Jun. 28, 2014

(65) Prior Publication Data

US 2015/0376912 A1 Dec. 31, 2015

(51) Int. Cl.

| | |
|---|---|
| ***E04H 15/60*** | (2006.01) |
| ***E04H 15/44*** | (2006.01) |
| *A63H 33/10* | (2006.01) |
| *E04H 15/62* | (2006.01) |

(52) U.S. Cl.

CPC ..... *E04H 15/60* (2013.01); *E04H 15/44* (2013.01); *A63H 33/106* (2013.01); *E04H 15/62* (2013.01)

(58) Field of Classification Search

CPC ..... E04H 15/60

See application file for complete search history.

(56) References Cited

U.S. PATENT DOCUMENTS

| | | | | | |
|---|---|---|---|---|---|
| 305,140 | A * | 9/1884 | Bradley | E21B 17/046 | 15/145 |
| 363,122 | A * | 5/1887 | Dimick | F16L 37/252 | 285/402 |
| 1,033,187 | A * | 7/1912 | Whitt | F16L 37/252 | 285/376 |
| 1,282,681 | A * | 10/1918 | Faribault | E04H 15/60 | 135/114 |

(Continued)

FOREIGN PATENT DOCUMENTS

| | | | | |
|---|---|---|---|---|
| FR | 1044357 A | * | 11/1953 | E04H 15/60 |
| GB | 190884 A | * | 1/1923 | E04H 15/60 |

*Primary Examiner* — David R Dunn
*Assistant Examiner* — Danielle Jackson

(57) ABSTRACT

An easy to use, reliable, easy to repair, universal, simple, lightweight, compact, portable, multi-use modular system of poles and interconnections. An operator configures a number of structures using brackets, supports, segmented shafts, and interconnection components. The segmented shafts have both the ability to make an attachment to retain a particular configuration while being able to break down the shafts for transportation or storage. Some embodiments include a sleeve that protects the tip of a pole and provide a cushion and separation between a pole and a ferrule thereby reducing breakage and increase reliability. Broken components are easily replaced in the field. The configuration of the structure is changed by the user to quickly adapt to changing needs. Multiple components can be carried by separate members of a group and combined together to form a more complex structure to meet the needs of the group.

18 Claims, 32 Drawing Sheets

(56) References Cited

U.S. PATENT DOCUMENTS 1,330,363 A * 2/1920 Whitt ..... E04H 15/60 135/114
2,712,950 A * 7/1955 Siebert ..... 15/145
3,441,037 A * 4/1969 Transeau ..... E04H 15/003 135/116
3,480,023 A * 11/1969 McConnell ..... E04H 15/62 135/118
4,911,573 A * 3/1990 Pietro ..... B25G 3/16 285/361
4,960,144 A * 10/1990 Wheatley ..... E04H 15/60 135/117
5,224,507 A * 7/1993 Vosse ..... E04H 15/58 135/115
5,290,974 A * 3/1994 Douglas ..... F01N 13/1805 181/228
5,651,732 A * 7/1997 Dufour ..... F16L 37/252 126/307 R
5,661,868 A * 9/1997 Panagakos ..... A46B 5/0033 15/144.4
5,741,084 A * 4/1998 Del Rio ..... A61B 17/1633 285/361
5,839,524 A * 11/1998 Sanford ..... E21B 17/06 166/360
6,200,060 B1 * 3/2001 Vernay ..... E04H 15/40 135/114
7,481,234 B1 * 1/2009 Gustafson ..... E04H 15/425 135/156
7,841,355 B2 * 11/2010 Livacich ..... E04H 15/001 135/114
7,861,776 B2 * 1/2011 McKee ..... E21B 17/046 166/237
8,210,577 B2 * 7/2012 Smolenski ..... A47L 9/244 285/361
8,776,813 B2 * 7/2014 DeLap ..... E04H 15/60 135/114
2003/0233718 A1 * 12/2003 Heathcock ..... B25G 1/04 15/144.4

* cited by examiner

MODULAR SYSTEM INCLUDING SHAFT SEGMENTS HAVING CONFIGURATION AND BREAKDOWN ATTACHMENTS

RELATED APPLICATIONS

This application is a divisional application of, and claims priority based on, U.S. patent application Ser. No. 12/955,886, entitled "MODULAR SYSTEM INCLUDING SHAFT SEGMENTS HAVING CONFIGURATION AND BREAKDOWN ATTACHMENTS". U.S. patent application Ser. No. 12/955,886 is a divisional application of, and claims priority based on, U.S. patent application Ser. No. 11/484,106, now U.S. Pat. No. 7,841,355, which is a continuation-in-part of, and claims priority based on, U.S. patent application Ser. No. 11/295,305, filed Dec. 5, 2005, entitled "MODULAR SYSTEM FOR CONCEALMENT AND SHELTER." This application is also a continuation-in-part of, and claims priority based on, U.S. patent application Ser. No. 11/155,398, filed Jun. 16, 2005, entitled "MODULAR SYSTEM FOR CONCEALMENT AND SHELTER." U.S. patent application Ser. No. 11/155,398 is a continuation-in-part of, and claims priority based on, U.S. patent application Ser. No. 11/045,736, filed Jan. 28, 2005, entitled "LIGHTWEIGHT PORTABLE CONCEALMENT MEANS AND METHODS." U.S. patent application Ser. No. 11/045,736 is a continuation-in-part of, and claims priority based on U.S. patent application Ser. No. 10/161,986, filed Jun. 4, 2002. This application, as well as its parents, grandparent, great-grandparent, great-great-grandparent, claim priority under 35 U.S.C. § 199(e) of U.S. provisional application Ser. No. 60/295,956, filed Jun. 4, 2001, entitled "LIGHTWEIGHT PORTABLE CONCEALMENT MEANS AND METHODS." Application 60/295,956; Ser. Nos. 10/161,986; 11/045,736; 11/155,398; 11/295,305; 11/484,106; and 12/955,886 are hereby included by reference.

BACKGROUND

Field of the Invention

This invention relates to a modular system of interconnected poles, especially those used to construct lightweight portable concealment and shelter systems.

Description of Prior Art

There is often a need to conceal or shelter oneself when researching wildlife, hunting, camping, working on construction projects, or working in the outdoors. Wildlife researchers conceal themselves so that they can film and study wildlife without disturbing the behavior of the animals. Hunters often conceal themselves in various hunting blinds to avoid being detected by their prey. Campers often conceal themselves to bathe, change clothes, and perform other personal or hygiene activities. Construction workers, military, law enforcement, and others who work in the outdoors also have similar needs for concealment. Children enjoy using various structures in the yard or a playroom. Various methods have been employed to accomplish these tasks.

The use of fiberglass pole segments that are interconnected with a simple metal ferrule has become standard for camping tent pole systems. Some of these pole systems use solid fiberglass poles. Others use a predetermined number of hollow fiberglass pole segments permanently interconnected with a single stretch cord that runs through the centers of the fiberglass poles. More recently precision machined all-metal pole systems have also been designed with a predetermined number of segments.

The use of such pole systems has several disadvantages such as:

- Being limited to a single design or configuration
- Breaking at the fiberglass pole tips
- Breaking of the fiberglass pole segment where the end metal ferrule contacts the fiberglass pole
- Placing uneven, heavy stress on the single stretch cord so that it breaks
- Being difficult to repair broken cords or segments
- Being difficult to replace a broken cord or segment in the field It is also desirable to have a blind that can provide shelter from the elements. Lightweight portable tents with nylon shells, rain flies, and external fiberglass poles are well known, but there have not been major innovations in basic structure and configuration of such tents in the last two decades. Each tent comes with a predetermined number of parts and is limited to a single configuration.

There is a need for a simple, lightweight, compact, portable, modular system of poles and interconnections so that the same poles can be used to configure a number of blinds, shelters, tents, and play structures. There is a need for such a system to allow for configuration with a configuration attachment and for temporary breakdown for transportation while maintaining the desired configuration. There is a need for more reliable pole system with less breakage and easy repair or replacement when there is a broken or damaged component.

What is needed is a modular system of components that could be used to construct a wide variety of outdoor blinds, shelters, tents, or play structures. With such a modular system, the same components could be used to create various blinds, shelters, tents, or play structures.

SUMMARY OF THE INVENTION

Accordingly, it is an objective of the present invention to provide an easy to use, reliable, easy to repair, universal, simple, lightweight, compact, portable, multi-use modular system of poles and interconnections.

Objects and Advantages

Accordingly, beside the objects and advantages described above, some additional objects and advantages of the present invention are:

1. To provide a modular system of components that can be used construct a variety of outdoor blinds and shelters.
2. To provide modular components that can be assembled in a specific configuration and then can be broken down without disassembly, so that the specific configuration can be quickly put up at a later time.
3. To provide a bracket that can be attached to either a vertical or horizontal structure, or that can be inserted into the ground.
4. To provide a method of removably attaching shaft segments whereby shafts can pass through and hold flexible materials such as shelter covers, floors, and panels.
5. To provide a method of removably attaching shaft segments whereby the shaft segments are held together regardless of whether an external pressure is forcing them towards or away from each other.
6. To provide improved means of construction with lower cost and longer reliability.
7. To provide a more reliable pole system with reduction of pole breakage.

8. To provide for easy in field replacement of broken pole segments or stretch cords.

DRAWING FIGURES

In the drawings, closely related figures have the same number but different alphabetic suffixes.

Figure 1A:
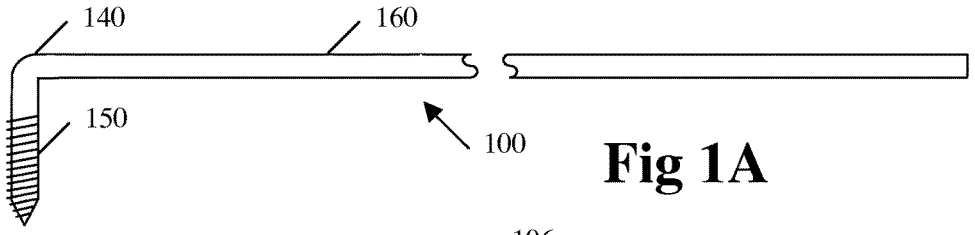
FIG. 1A through FIG. 1C show various embodiments of the support of the present invention.

| REFERENCE NUMERALS IN DRAWINGS | |
|---|---|
| 100 | attaching pivoting support |
| 102 | threaded support |
| 104 | threaded connector |
| 106 | shaft |
| 107 | segmented shaft |
| 126 | (a) cord |
| 126 | (b) cord attachment or knot |
| 126 | elastic cord |
| 140 | bend |
| 150 | first leg |
| 160 | second leg |
| 170 | end-cap |
| 194 | dimpled connector |
| 195 | inward protrusion |
| 197 | (a-c) retaining dimple |
| 199 | shaft segment |
| 700 | straight connector |
| 760 | (a-e) connected shaft |
| 1070 | inserting end (male) |
| 1072 | receiving end (female) |
| 1074 | machined end |
| 1075 | cord retainer |
| 1076 | threaded end |
| 1094 | (a-f) locking slot |
| 1094 | (d) three-notched locking slot |
| 1096 | slot mark |
| 1097 | (a-i) indicator |
| 1420 | 4-way receiving end connector |
| 1422 | angled two-way receiving connector |
| 1540 | cover |
| 1574 | (a-b) bow cord attachment |

-continued

| REFERENCE NUMERALS IN DRAWINGS | |
|---|---|
| 1626 | bow cord |
| 1740 | receiving-to-receiving connector |
| 1752 | 3-way receiving end connector |
| 1760 | inserting-to-inserting connector |
| 1762 | slotted connector |
| 1800 | adjustable bracket |
| 1802 | alternate bracket |
| 1810 | (a-d) bracket leg |
| 1820 | quick release |
| 1846 | lower nut |
| 2210 | receiving base |
| 2212 | base plate |
| 2214 | base receiving end |
| 2220 | inserting base |
| 2231 | sharpened shaft with slot |
| 2235 | unthreaded arm (or leg) |
| 3072 | channeled receiving end |
| 3074 | dual-locking channeled receiving end |
| 3093 | multi-leg locking channel |
| 3094 | (a-d) locking channel |
| 3095 | (a-d) neck |
| 3096 | (a-d) channel leg |
| 3097 | alternate indicator |
| 3098 | (a-c) bay |
| 3102 | sleeved support |
| 3103 | graduated sleeve |
| 3104 | (a-h) sleeve |
| 3106 | cord opening |
| 3107 | shaft opening |
| 3108 | plain sleeve |
| 3180 | (a-d) banded support |
| 3181 | (a-b) retaining band |
| 3194 | (a-b) channeled connector |
| 3195 | (a-i) hemispherical outward protrusion |
| 3196 | (a-i) rectangular pyramidal outward protrusion |
| 3197 | (a-d) half-length shaft segment |
| 3198 | (a-d) retaining sleeve |
| 3199 | (a-1) channeled shaft segment |
| 3202 | two-channeled receiving end |
| 3203 | three-channeled receiving end |
| 3204 | four-channeled receiving end |
| 3206 | graduated channeled receiving end |
| 3400 | (a-d) dual-swivel clip |
| 3410 | (a-b) pole clip |
| 3412 | (a-b) pole clip member |
| 3414 | (a-d) cord clip |
| 3416 | (a-b) bow cord clip |
| 3420 | (a-b) swivel clip |
| 3430 | dual-swivel hub |
| 3432 | hub grip |
| 3434 | (a-b) flared edge |
| 3450 | (a-d) stake with cord clips |
| 3452 | multiple cord clip member |
| 3454 | stake member |
| 3456 | stake with cord clips and leg |
| 3460 | (a-d) alternate dual-swivel clip |
| 3462 | (a-b) fixed cord clip |
| 3464 | (a-b) inserting end swivel |
| 3466 | alternate swivel clip |
| 3468 | alternate dual-swivel hub |
| 3481 | 2-way inserting end connector with protrusions |
| 3482 | angled 2-way inserting end connector with protrusions |
| 3483 | 3-way inserting end connector with protrusions |
| 3484 | 4-way inserting end connector with protrusions |
| 3485 | 3-way inserting end corner connector with protrusions |
| 3486 | obtuse 2-way inserting end connector with protrusions |
| 3492 | angled 2-way receiving end connector with channels |
| 3493 | 3-way receiving end connector with channels |
| 3494 | 4-way receiving end connector with channels |
| 3495 | 3-way receiving end corner connector with channels |
| 3496 | obtuse 2-way receiving end connector with channels |
| 3500 | pivoting intersection connector |
| 3510 | intersection member with band |
| 3512 | intersection band |
| 3514 | intersection member with alternate band |
| 3516 | alternate band |
| 3520 | intersection member with hub |

-continued

| REFERENCE NUMERALS IN DRAWINGS | |
|---|---|
| 3522 | intersection hub |
| 3524 | latch thumb grip |
| 3526 | intersection latch |
| 3530 | dual-swivel pole receptacle |
| 3532 | alternate dual-swivel pole receptacle |
| 3534 | (a-b) pole receptacle |
| 3540 | pressure release spring |
| 3542 | sheath (protective tubing) |
| 3550 | (a-b) universal clip |
| 3560 | (a-d) dual-universal clip base |
| 3570 | (a-d) corner base connector |
| 3572 | alternate corner base connector |
| 3574 | corner base connector with clips |
| 3600 | (a-d) base segmented shaft |
| 3700 | pivoting arches |

Special Definitions channel—an at least partially enclosed path, groove, or slot, especially one used to removably attach or lock components together.

cord—a flexible, and possibly elastic, filament including but not limited to a fiber, thread, string, rope, twine, wire, cable, yarn, thong, tendon, or line.

curtain—a concealing or protecting sheet of material.

neck—a relatively narrow part of a channel used to increase the amount of force necessary on a part for that part to pass through the channel.

shaft—a supporting member in construction including but not limited to any solid or hollow, round or rectangular bar, beam, pole, rod, spar, or tube composed of wood, plastic, metal, or composite material.

DESCRIPTION OF THE INVENTION

The present invention comprises easy to use, reliable, easy to repair, universal, simple, lightweight, compact, portable, multi-use modular system of poles and interconnections. The system includes novel shaft segments that can be attached in various configurations and then broken down without detaching the attachments.

The present invention includes the discoveries 1) that conventional fiberglass poles break at the tip because the tip is exposed to chips and cracks from being forced into the ferrule by the stretch cord or from making contact with other objects and 2) that conventional fiberglass poles break where the end of the ferrule scratches or scores the edge of the fiberglass pole when a bending force is applied to the pole. The present invention includes a solution to these two discoveries. The system includes the use of a sleeve which protections the tip of the pole from breakage. The sleeve also makes the pole system more reliable by reducing breakage by protecting a pole segment from being scratched or scored by contact with the edge of the ferrule and further by providing a cushion for the forces between the pole segments and the ferrule and other interconnection parts.

Figure 1B:
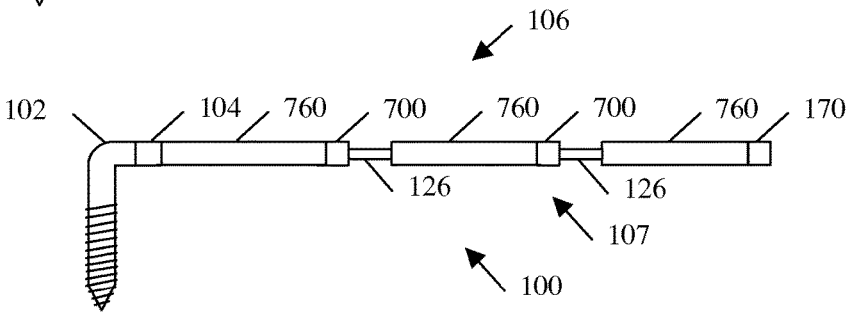

FIG. 1A Through FIG. 1B

FIG. 1A illustrates an exemplary embodiment of an attaching pivoting support 100. The support 100 is bent at an angle. The bend 140 results in two legs: a first leg 150 and a second leg 160. The first leg 150 has a threaded portion for threaded attachment to an attaching structure 130, such as a tree, pole, rock, wall, or attaching fastener 230. The bend 140 allows a user to exert a force on the second leg 160 that acts as a lever to screw the first leg 150 into the attaching structure 130.

The angle of the bend 140 is shown as a 90-degree angle; however, good results have also been obtained by using an obtuse angle. An obtuse angle still provides a leveraged force but is less likely to cause the second leg 160 to be blocked by tree branches or other obstructions.

In this exemplary embodiment, a portion of the threaded portion of the first leg 150 is cylindrical, not tapered, so that once attached to the attaching structure 130, the second leg 160 can be rotated up and down around the first leg 150 without losing frictional force necessary to hold the attaching pivoting support 100 in the position the operator leaves it.

Figure 1C:
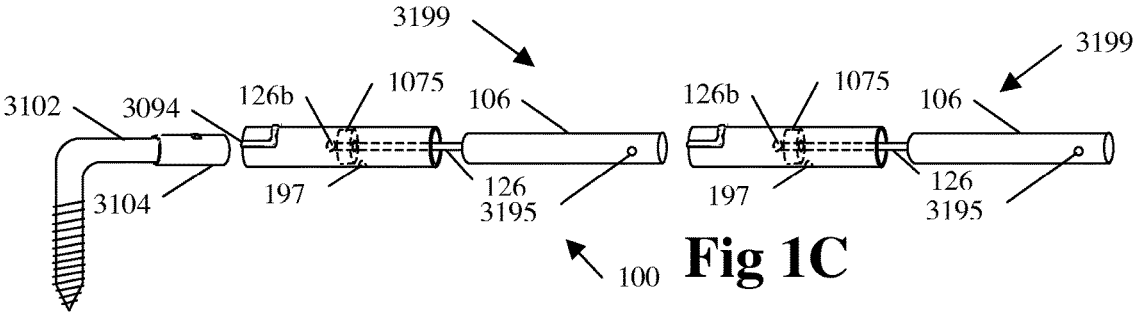

The attaching pivoting support 100 can be constructed of a single shaft. However, depending on construction materials, a lighter embodiment can be constructed by combining various components. This invention anticipates that any combination of parts can be used to make the attaching pivoting support 100 with equivalent structural features and functions. Examples of some embodiments are shown in FIG. 1B through FIG. 1C.

FIG. 1B shows an embodiment of the attaching pivoting support 100 comprised of the threaded support 102, the threaded connector 104, and the shaft 106. The threaded connector 104 screws onto the threaded support 102 and is attached to the shaft 106. Good results have been obtained by making the threaded support 102 from hardened steel, by making the threaded connector 104 from a metal tube, and by making the shaft 106 from fiberglass. Good attachment results have been obtained by gluing the metal tube to the fiberglass. In this embodiment the shaft 106 is comprised of a plurality of connected shafts 760 each connected to a connector. In this embodiment each connected shaft 760 is connected to a straight connector 700. These collectively form a segmented shaft 107.

FIG. 1B further shows an example where the shafts are hollow and connected with an elastic cord 126. The elastic cord 126 running through the centers of the shaft 106 components (e.g. 760) connects the components. The elastic cord 126 prevents components from falling and makes it easier to assemble the shaft 106.

FIG. 1C

FIG. 1C shows the currently preferred embodiment the attaching pivoting support 100 comprised of the sleeved support 3102 and the second leg 160 comprised of a plurality of channeled shaft segments 3199 (which is one embodiment of a shaft segment 199). The sleeved support will be described in more detail in reference to FIG. 4E. The channeled shaft segments 3199 will be described in more detail in reference to FIGS. 2B and 2D.

Figure 1D:
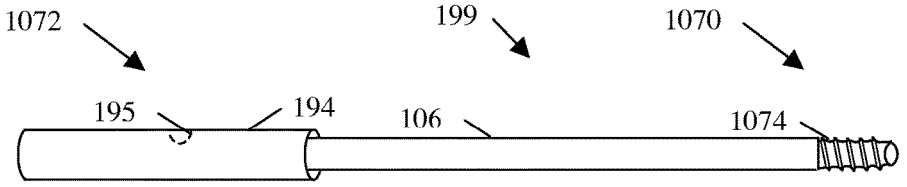
FIG. 1D through FIG. 1I show various connectors having inward protrusions.
Figure 1E:
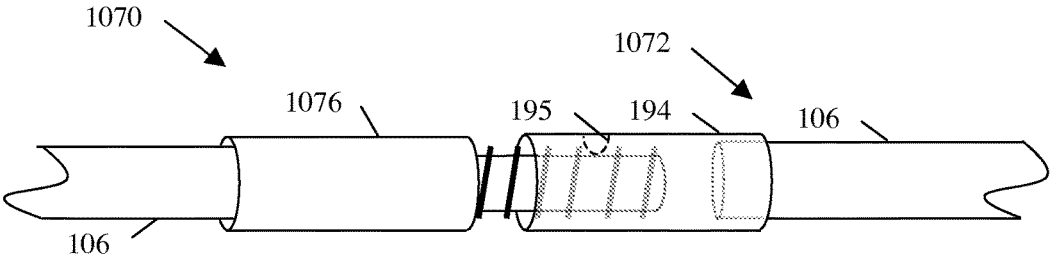

FIG. 1D Through FIG. 1E

FIG. 1D illustrates an exemplary embodiment of a shaft segment 199. A plurality of shaft segments 199 may be attached to form a longer, segmented shaft 107. Many of the modules of the present invention are comprised of shaft segments 199 of various lengths that can be connected in various configurations. Examples of segmented shafts 107 are a base segmented shaft 3600 shown in parts in FIGS. 6B through 6C and 7B though 7D and assembled in FIG. 8D, and pivoting arches 3700 shown, for example in FIG. 8A and FIG. 8C.

As shown in FIG. 1D, a shaft segment 199 has an inserting end 1070 (also called in the art a male end) and a receiving end 1072 (also called in the art a female end). The inserting end 1070 has a means of making a configuration attachment. The other end is a receiving end 1072 compatible to receive the inserting end 1070. The receiving end 1072 also has a corresponding means of completing the configuration attachment.

In the example shown in FIG. 1D, the configuration attachment is threads 1074 which can be formed by machining the end of the shaft 106 resulting in a machined end as shown in FIG. 1D.

The receiving end 1072 as shown in FIG. 1D can be any connector with an inward protrusion 195, such as the dimpled connector 194 having at least one thread receiving inward protrusion 195. The dimple as shown is just one example of an inward protrusion 195. Other types of inward protrusions 195 can be formed by molding, welding, or machining the material.

As shown in FIG. 1E the inserting end 1070 of one shaft segment 199 can be threadedly attached to the receiving end 1072 of a second shaft segment 199. Two or more shaft segments 199 can be connected to form a threaded segmented shaft 109.

Figure 8A:
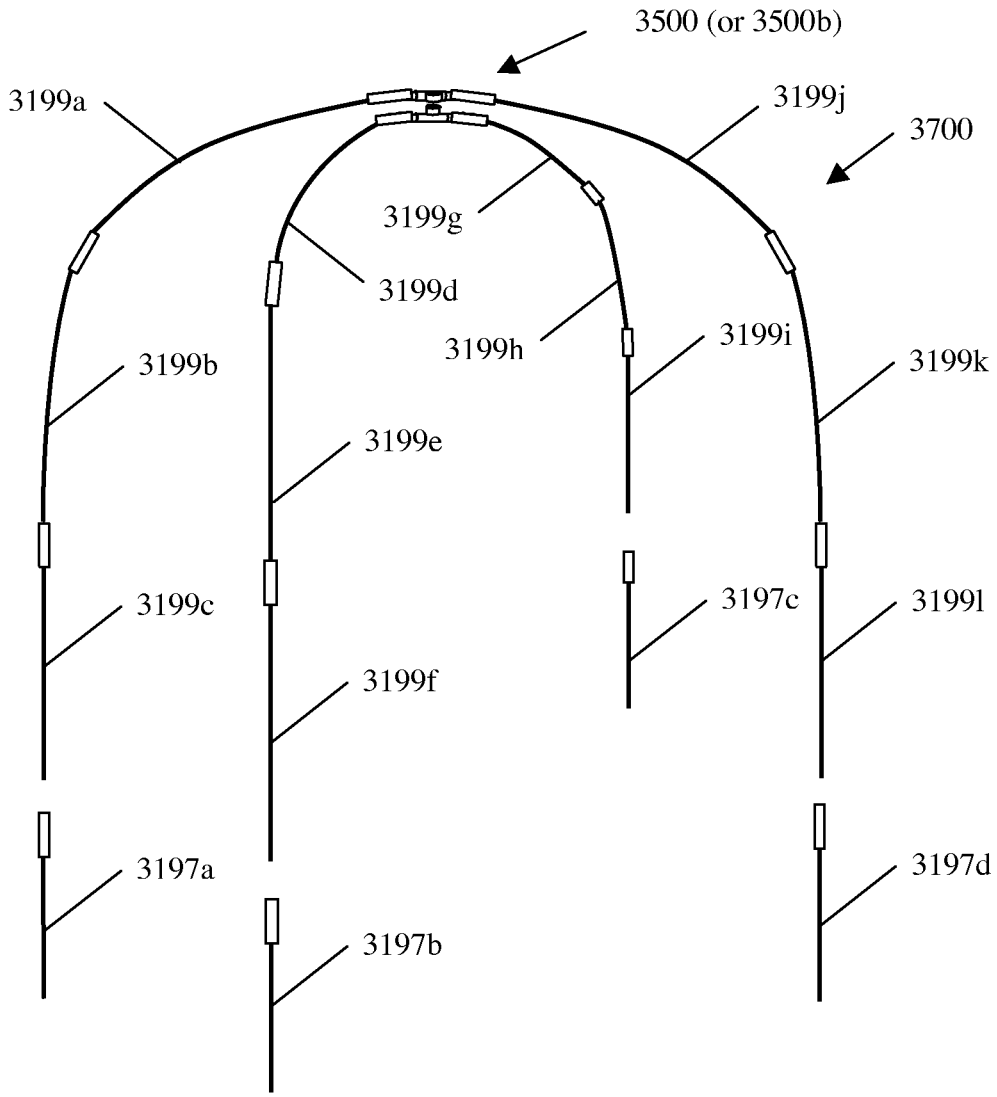
FIG. 8A through FIG. 8C and FIG. 8E show embodiments of pivoting arches.

In a currently preferred embodiment, each shaft segment 199 is about 13.5 inches (or about 34.5 cm) in length (also known as a "half stick" or half-length shaft segment 3197). The standard size of a shaft 106 of a support 100 is about twenty-six inches (or about sixty-six centimeters) which can be made by using two half sticks. Because a portion of the inserting end 1070 is inserted into a portion of the receiving end 1072 the overall length of an assembled segmented shaft 107 is less than the sum of the segment lengths, but greater than the sum of the shaft 106 lengths, because about one inch (or three centimeters) is added inside each connector (see discussion regarding lengths below in reference to FIG. 3M). Thus, in a currently preferred embodiment as shown in FIG. 8A, each arch in the pivoting arches 3700 comprises six full-length shaft segments (preferably, channeled shaft segment 3199) and two half-length shaft segments 3197, for an assembled length of about 190 inches (or about 483 cm).

FIG. 1F Through FIG. 1I

Figure 1F:
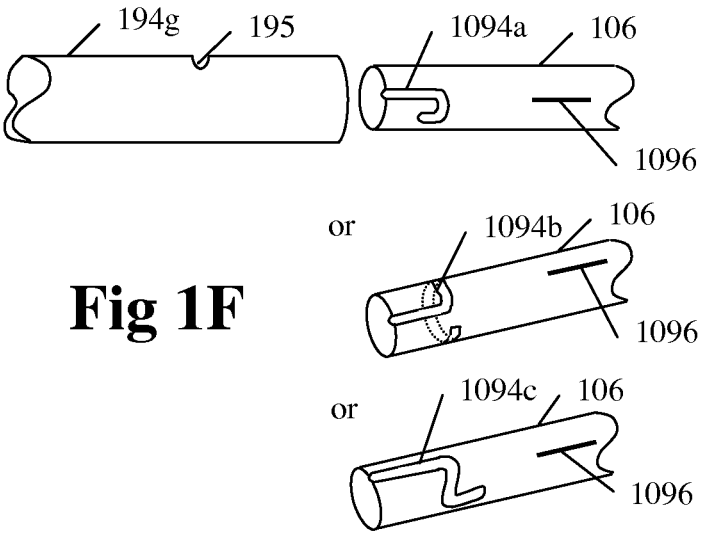

As shown in FIG. 1F, in one embodiment of the present invention configuration attachment can be made with an inward protrusion 195 that passes through a corresponding locking slot 1094. As shown in FIG. 1F, the locking slot 1094 can have a path with a shape that will lock the two pieces together. A J-shaped locking slot 1904*a* can be useful if the shaft 106 has force applied to it that brings it back toward the connector. Alternatively, when the force can be either a pulling or pushing force, a locking slot 1094*b* can have a path that circles almost completely around the shaft, or locking slot 1094*c* can have a zig-zag path. Because the locking slot 1094 is hidden when inserted into the dimpled connector 194*g*, a slot mark 1096 can be made on the shaft 106 showing the position of the locking slot entry and exit. The locking slot has the advantage over connector threads 1077 in that the connection can be made or released with a rotation that is less than one complete rotation.

A configuration attachment, such as locking slot 1094, can be used to temporarily secure the connection of a shaft 106 to a dimpled connector 194*g*.

Figure 1G:
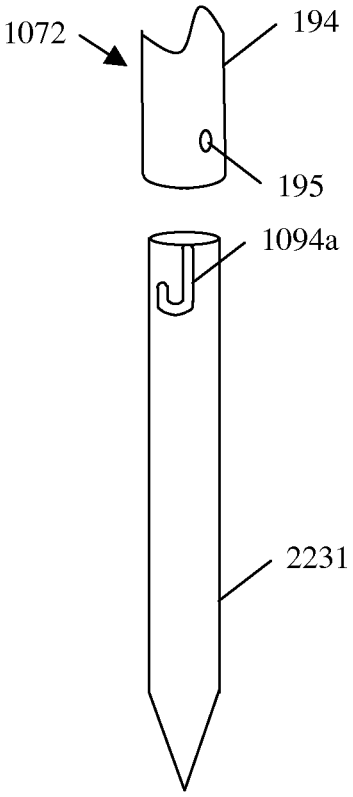

FIG. 1G shows a sharpened shaft with slot 2231. The slot 1094*a* is used to removably secure the sharpened shaft 2231 to the receiving end 1072 of a shaft segment. This is one example of how different components can be connected using a corresponding means for configuration attachment.

Figure 1H:
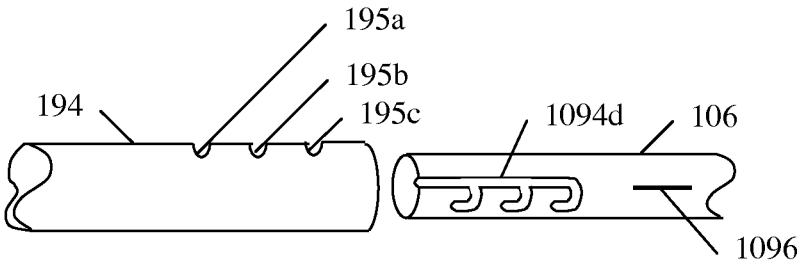

FIG. 1H shows another exemplary embodiment of a dimpled connector 194 with a plurality of inward protrusions 195*a* through 195*c* which connect and lock with corresponding locking slot 1094*d* multiple J-shape locking paths. In this embodiment the length of the connection can be varied by placing the inward protrusion at the end 195*c* in one of each of the multiple locking paths. This can be used to adjust the length of the segmented shaft. Note that locking slot 1094*d* is also compatible with a connector with only one inward protrusion 195.

Figure 1I:
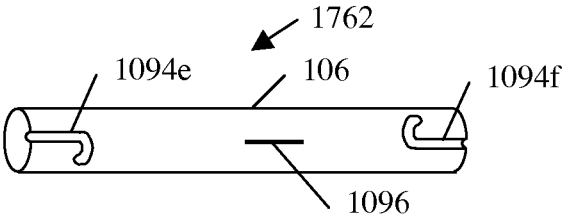

FIG. 1I shows an embodiment of a inserting-to-inserting connector 1760, which comprises a short shaft having opposing locking slots (1094*e* and 10940 on opposite ends. Two shaft segments, for example 199, are connected by inserting the slotted connector 1762 in the corresponding receiving end 1072 of adjacent shafts and twisting clockwise to lock. The shafts can be disconnected by twisting both shafts counter-clockwise.

Figure 2A:
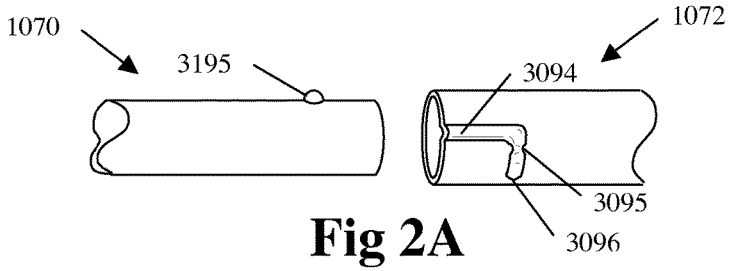
FIG. 2A through FIG. 2E show various connectors having outward protrusions.
Figure 2B:
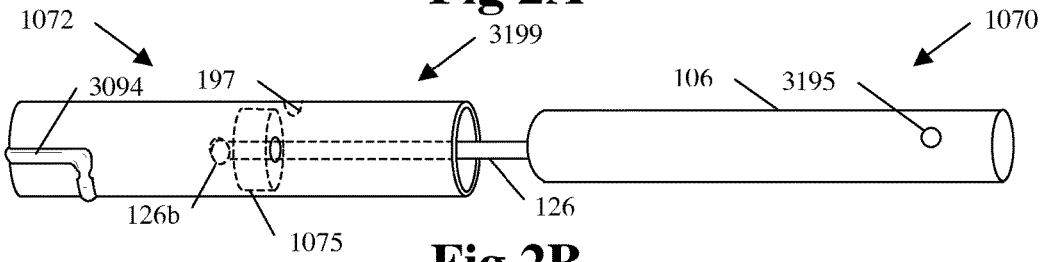

FIG. 2A and FIG. 2B

While the embodiments shown in FIGS. 1A, 1B, and 1D through 1I are similar to embodiments shown in the parent applications, FIG. 1C showed an embodiment of the channeled shaft segment, which is more fully disclosed in the present application.

FIG. 2A shows a novel embodiment of a receiving end 1072 having a locking channel 3094 capable of receiving an inserting end 1070 with an outward protrusion. As shown in FIG. 2A the locking channel has a bend in the path forming a channel leg 3096. The locking channel 3094 also features a neck 3095 that is a relatively narrow portion of the channel.

FIG. 2A also shows a corresponding novel embodiment of an inserting end 1070 having an outward protrusion. As shown in FIG. 2A the outward protrusion is a hemispherical outward protrusion 3195. The outward protrusion is not limited to hemispherical shape; for example, in the currently preferred embodiment as shown in FIG. 3B, the outward protrusion is shown as a pyramidal outward protrusion 3196.

When an outward protrusion passes through the locking channel 3094 and reaches the neck 3095, the user must assert a slightly stronger force to cause the outward protrusion to pass the neck 3095. The neck 3095 will then prevent the outward protrusion from passing back out of the locking channel without the assertion of a slightly stronger force. Thus the locking channel 3094 operates with the outward protrusion (3195 or 3196) to form a configuration connection that will remain connected until disconnected by the user.

An advantage of a partially enclosed channel 3094 formed in the wall of a ferrule is that the structural strength of the cylinder is maintained. The rounded channel also asserts a more even force on the outward protrusion 3195 or 3196.

A locking channel 3094 may be made by using a metal tool having the shape of the inserting end 1070 shown in FIG. 2A including the hemispherical outward protrusion. The tool is forced into a metal ferrule creating the mouth of the channel of a desired length, and then, the tool is rotated clockwise to create the bend and channel leg 3096. The tool is then removed. The result is a partially enclosed channel 3094 with the corresponding size and shape to allow an outward protrusion (such as 3195 or 3196) to pass through and lock in the locking channel 3094. The neck is created by striking one or more points on the channel to narrow the channel slightly.

Alternatively, the locking channel 3094 may be pressed into a metal ferrule with a die. Using this method the neck 3095 may be pressed simultaneously with the locking channel 3094.

A hemispherical outward protrusion may be made by gluing a solid hemisphere onto a shaft 106. Good results have been obtained by gluing half of a nylon sphere onto a prepared area on a fiberglass shaft. The area may be prepared by tooling a shallow, flat bottomed, circular depression in the fiberglass shaft and gluing the nylon hemisphere in the circular depression with a polyserate adhesive (such as Devcon brand Plastic Welder II, #14340). Testing has shown that the nylon will yield (e.g. distort its shape) before the glue or the fiberglass bonds will break. The nylon hemisphere is soft enough to pass through the neck 3095 but firm and strong enough to maintain the connection.

FIG. 2B shows the details of the novel channeled shaft segment 3199 (shown earlier in FIG. 1C). In addition to the configuration attachment shown in FIG. 2A, each shaft segment 3199 also has a breakdown attachment. The connector at the receiving end 1072 is connected to the shaft 106 using a cord 126 using a cord retainer 1075. The cord retainer 1075 is held in place by one or more retaining dimples 197. The cord 126 passes through the cord retainer 1075 and is attached using the cord attachment or knot 126*b*. This feature allows a plurality of shaft segments 199 to be locked together (along with various brackets, supports, and connectors) to form various configurations. Once configured the structure can be broken down quickly by separating the receiving end connector from the shaft 106 by stretching the cord 126*a* and bending the pieces at the stretch cord 126. The structure can be quickly put up by reinserting the end of shaft 106 into the connector to which it is attached by the cord 126.

Unlike conventional tent poles with a single elastic cord, the present invention has an elastic cord 126 inside each shaft segment. This allows for the modular features of the present invention where any number of shaft segments 3199 can be configured together using the configuration attachments. Further, if an elastic cord 126 does break, the damaged shaft segment 3199 can be replaced in the field with an extra shaft segment 3199 without any tools.

Figure 2C:
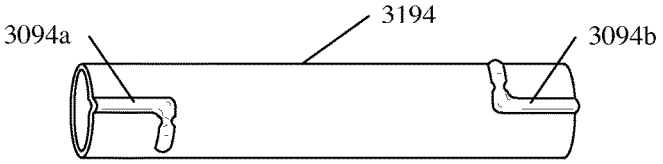
Figure 2D:
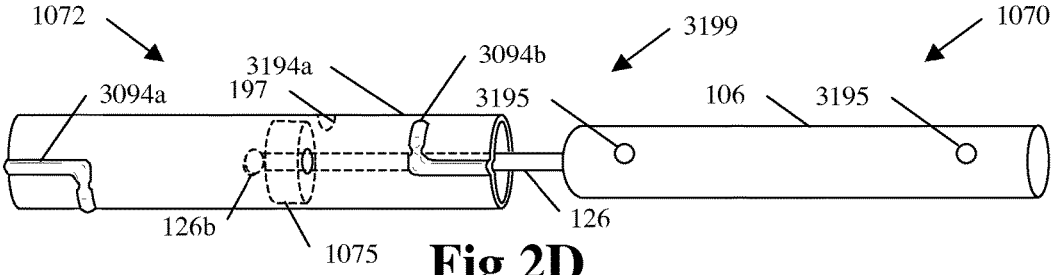

FIG. 2C and FIG. 2D

FIG. 2C shows a novel embodiment of a channeled connector 3194 have two receiving ends 1072 each having a locking channel 3094*a* and 3094*b*, respectively. Each locking channel 3094 is capable of receiving an inserting end 1070 with an outward protrusion.

FIG. 2D shows an alternate embodiment of novel channeled shaft segment 3199. In contrast to the embodiment shown in FIG. 2B, this embodiment comprises a channeled connector 3194 and a shaft 106 with two outward protrusions (3195 shown as shown or 3196), one on each end of the shaft. The channeled connector 3194*a* at the receiving end 1072 is connected to the shaft 106 using a cord 126 using a cord retainer 1075. The cord retainer 1075 is held in place by one or more retaining dimples 197. The cord 126 passes through the cord retainer 1075 and is attached using the cord attachment or knot 126*b*. Like the embodiment in FIG. 2B, this embodiment can be used to construct various configuration which can breakdown. Additionally, this embodiment has the advantages that the user can lock the breakdown connections when the segmented shaft 107 needs to provide tensile strength or when the user wants to control which segment in a segmented shaft 107 breaks down.

FIG. 2E

Figure 2E:
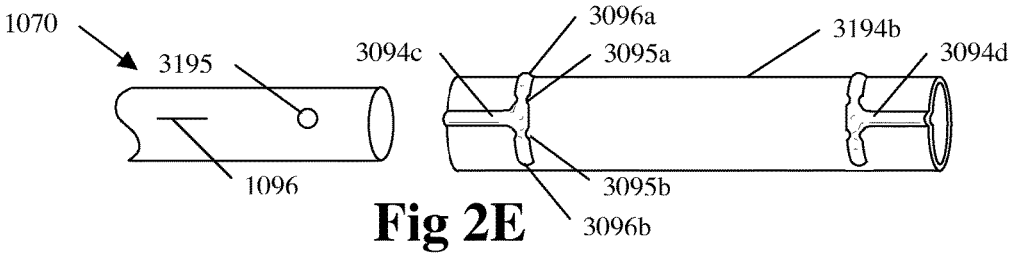

FIG. 2E shows another embodiment of a channeled connector 3194*b* having two receiving ends 1072 each having alternate locking channels 3094*c* and 3094*d*, respectively. In this embodiment each locking channel 3094 has two opposing channel legs 3096*a* and 3096*b*, respectively. Each channel leg has a neck 3095*a* and 3095*b*, respectively. This embodiment has the advantage of being able to lock with either a clockwise or counter-clockwise rotation.

FIG. 2E also shows the inserting end 1070 having a slot mark 1096 on the shaft 106. The slot mark 1096 is aligned with the outward protrusion 3195 so that the user can determine which direction to rotate the connection to lock or unlock the connection.

Figure 3A:
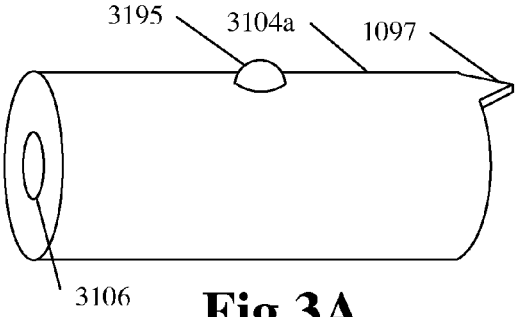
FIG. 3A through FIG. 3N show various embodiments of sleeves.
Figure 3C:
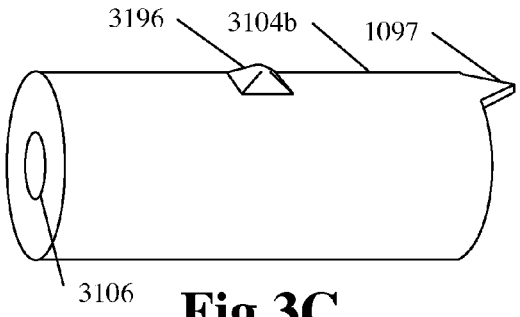
FIG. 3O through FIG. 3R show various embodiments of channeled connectors.
Figure 3B:
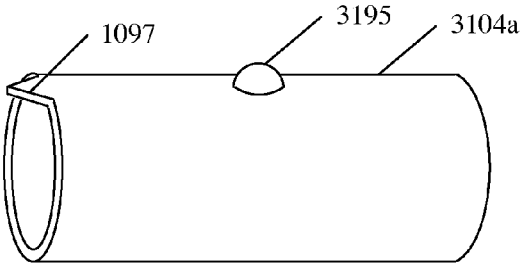
Figure 3D:
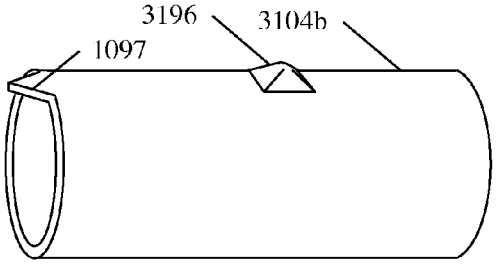
Figure 3E:
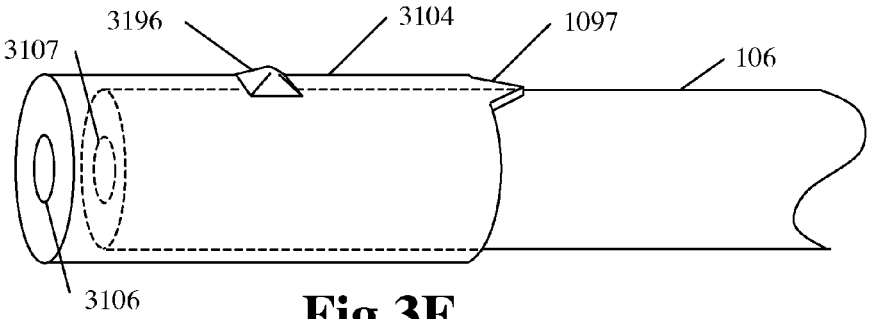
Figure 3F:
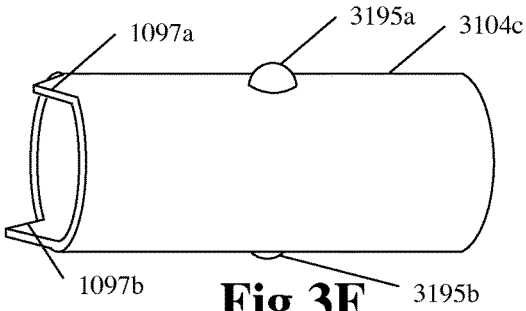
Figure 3G:
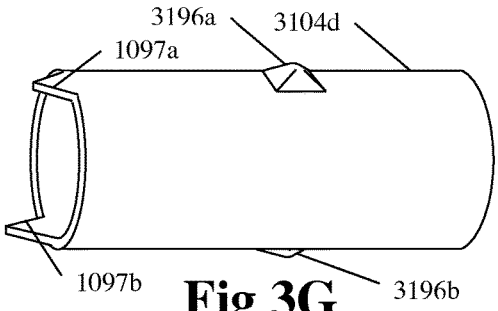
Figure 3H:
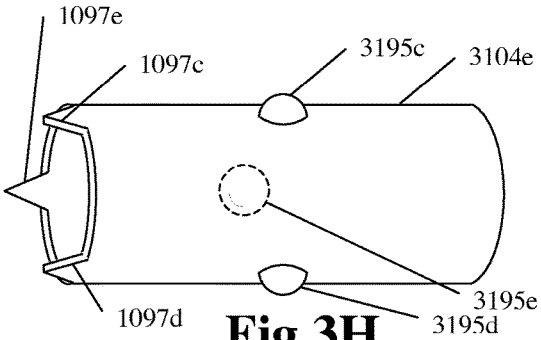
Figure 3I:
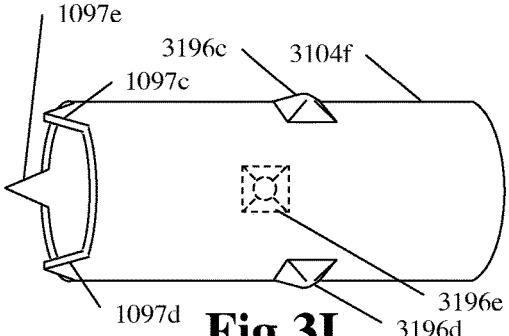
Figure 3J:
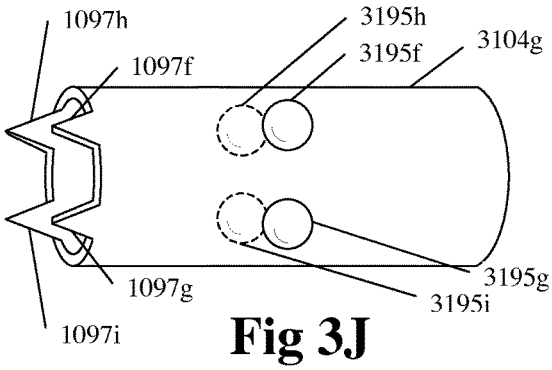
Figure 3K:
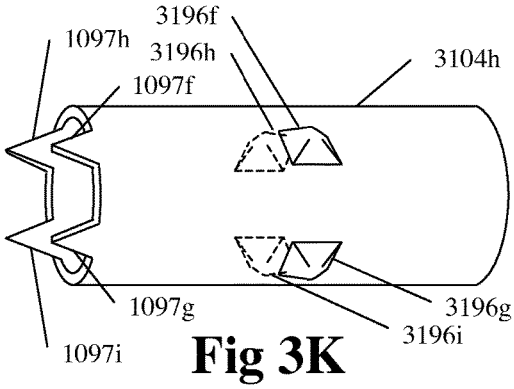
Figure 3L:
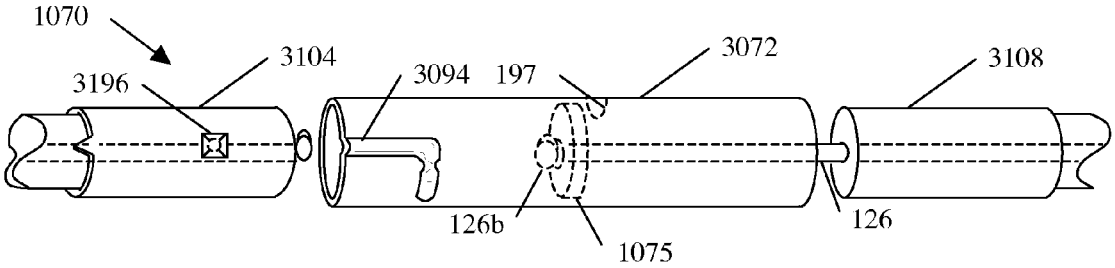
Figure 3M:
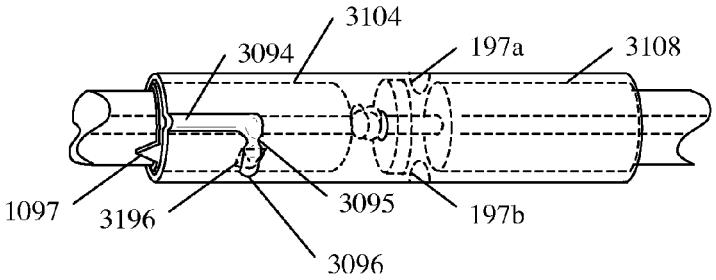
Figure 3N:
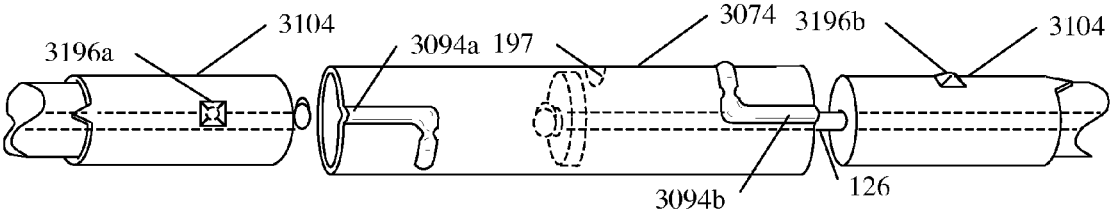

FIG. 3A Through FIG. 3N

During testing and investigation of breakage of previous pole systems, we discovered two reasons for failure of fiberglass pole. First, we learned convention fiberglass poles break at the tip because the tip is exposed to chips and cracks from being forced into the ferrule by the stretch cord or from making contact with other objects such as dirt and rocks. Second, fiberglass poles break where the end of the metal ferrule scratches or scores the edge of the fiberglass pole when a bending force is applied to the pole. Much like a conventional glass cutter, the process or scoring the fiberglass and the mechanical "tapping" of the ferrule against the scored ring leads to a weakness in the fiberglass pole allowing the pole to break when a segment shaft is bent to form an arch.

FIGS. 3A through 3N show embodiments of novel sleeves 3104 which address these two problem areas. The present invention includes a sleeve which protections the tip of the pole from breakage. The sleeve also makes the pole system more reliable by reducing breakage by protecting a pole segment from being scratch or scored by contact with the edge of the ferrule and, further, by providing a cushion for the forces between the pole segments and the ferrule and other interconnection parts.

FIG. 3A and FIG. 3B show an embodiment of a sleeve 3104*a* having a hemispherical outward protrusion 3195. The sleeve has an end that covers and protects the ends of the fiberglass strands that are normally exposed in the tip of the fiberglass shaft. The sleeve end has a cord opening 3106 that allows an elastic cord 126 (not shown) to pass through the sleeve 3104. The sleeve also has an indicator 1097 that shows the user where the outward protrusion 3195 is located when it is inserted in a locking channel 3094.

FIG. 3C and FIG. 3D show another embodiment of a sleeve 3104*b* having a rectangular pyramidal outward protrusion 3196. The sleeve 3104*b* with pyramidal outward protrusion 3196 is currently the preferred embodiment. The sleeve has an end that covers and protects the ends of the fiberglass strands that are normally exposed in the tip of the fiberglass shaft. The sleeve end has a cord opening 3106 that allows an elastic cord 126 (not shown) to pass through the sleeve 3104. The sleeve also has an indicator 1097 that shows the user where the outward protrusion 3196 is located when it is inserted in a locking channel 3094.

FIG. 3E shows a sleeve 3104 positioned over the tip of a hollow shaft 106. The cord opening 3106 is aligned with the shaft opening 3107. The sleeve may be permanently bonded to the end of the shaft 106. Good flexible adhesion results have been obtained using Mr. Sticky's brand Underwater Glue manufactured by AII of Fairoaks, Calif.

A currently preferred embodiment of the sleeve 3104 is made of plastic, such as polyoxymethylene or acetal. The sleeve wall is preferably 2 millimeters thick and the sleeve end is preferably 4 millimeters thick.

FIG. 3F shows an alternate embodiment of the sleeve 3104*c* having two hemispherical outward protrusions 3195*a* and 3195*b*, respectively, and two indicators 1097*a* and 1097*b*, respectively.

FIG. 3G shows an alternate embodiment of the sleeve 3104*d* having two pyramidal outward protrusions 3196*a* and 3196*b*, respectively, and two indicators 1097*a* and 1097*b*, respectively.

FIG. 3H shows an alternate embodiment of the sleeve 3104*e* having three hemispherical outward protrusions 3195*c*, 3195*d*, and 3195*e*, respectively, and three indicators 1097*c*, 1097*d* and 1097*e*, respectively.

FIG. 3I shows an alternate embodiment of the sleeve 3104*f* having three pyramidal outward protrusions 3196*c*, 3196*d*, and 3196*e*, respectively and three indicators 1097*c*, 1097*d* and 1097*e*, respectively.

FIG. 3J shows an alternate embodiment of the sleeve 3104*g* having four hemispherical outward protrusions 3195*f*, 3195*g*, 3195*h*, and 3195*i*, respectively, and four indicators 1097*f*, 1097*g*, 1097*h*, and 1097*i*, respectively.

FIG. 3K shows an alternate embodiment of the sleeve 3104*h* having four pyramidal outward protrusions 3196*f*, 3196*g*, 3916*h*, and 3196*i*, respectively four indicators 1097*f*, 1097*g*, 1097*h*, and 1097*i*, respectively.

FIG. 3L shows a currently preferred embodiment of the interconnections of the present invention. The inserting end 1070 of the shaft 106 is protected by a sleeve 3104. The opposite end of the shaft 106 which inserts into the breakdown side of the channeled receiving end 3072 is protected with a plain sleeve 3108.

Unlike conventional pole systems where the inside diameter is approximately the same size as the outside diameter of the fiberglass pole, in this embodiment, the inside diameter of the ferrule is approximately 2.5 millimeters larger than the outside diameter of the poles (e.g. shafts 106). The separation between the metal ferrule and the fiberglass pole prevents the edge of the metal ferrule from scratching or scoring the fiberglass pole.

FIG. 3M shows a currently preferred embodiment with the configuration attachment locked and the breakdown attachment made. The outward protrusion 3196 is shown locked past the neck 3095 of the channel 3094 in the channel leg 3096. This embodiment is also shown with two retaining dimples 197*a* and 197*b*, respectively. The use of two retaining dimples 197 is currently preferred to hold the cord retainer 1075 in place. The cord retainer 1075 is preferably six millimeters in length. The cord knots are approximately six millimeters in length. The two sleeve ends are about 2.5 millimeters in length each. Thus, the space required inside the ferrule between the two fiberglass poles is approximately thirty millimeters (or 3 centimeters). The outward protrusion (3195 or 3196) and the bend forming the channel leg are both about 16 millimeters from the respective end. This allows each inserting end to be inserted about 34 millimeters. A ferrule length of ninety millimeters is sufficient to make the necessary configuration connection.

FIG. 3N shows an alternate embodiment comprising a dual-locking channeled receiving end 3074 wherein the opposite end of the shaft 106 which inserts into the breakdown side of the dual-locking channeled receiving end 3074, i.e. into locking channel 3094*b*, is protected with a sleeve 3104 which is identical to the sleeve 3104 on the inserting end 1070.

FIG. 3O Through FIG. 3R

FIG. 3O through FIG. 3R show alternate embodiments of the receiving ends 1072.

Figure 3O:
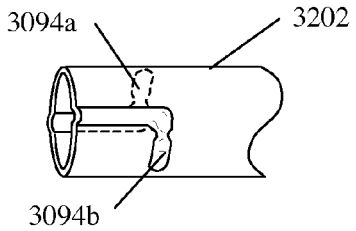

FIG. 3O shows a two-channeled receiving end 3202 having two locking channels 3094*a* and 3094*b*, respectively. This embodiment can receive an inserting end 1070 with either one or two outward protrusions (3195 or 3196), such as those shown, for example, in FIG. 2A and FIG. 3A through 3E, or FIG. 3F and FIG. 3G, respectively.

Figure 3P:
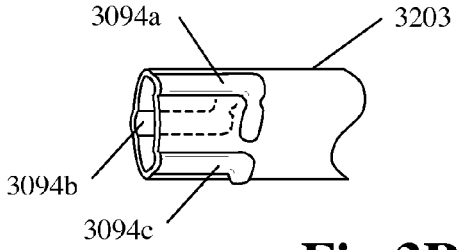

FIG. 3P shows a three-channeled receiving end 3203 having three locking channels 3094*a*, 3094*b*, and 3094*c*, respectively. This embodiment can receive an inserting end 1070 with either one or three outward protrusions (3195 or 3196), such as those shown, for example, in FIG. 2A and FIG. 3A through 3E, or FIG. 3H and FIG. 3I, respectively.

Figure 3Q:
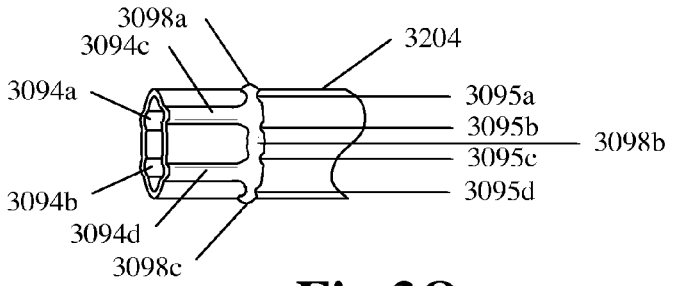

FIG. 3Q shows a four-channeled receiving end 3204 having four locking channels 3094*a*, 3094*b*, 3094*c*, and 3094*d*, respectively. This embodiment can receive an inserting end 1070 with either one, two or four outward protrusions (3195 or 3196), such as those shown, for example, in FIG. 2A and FIG. 3A through 3E, FIG. 3F and FIG. 3G, or FIG. 3J and FIG. 3K, respectively. The channel legs 3096 are shown merged such that a bay 3098 is formed between each channel 3094. For example, bay 3098*b* is formed by necks 3095*b* and 3095*c*. An outward protrusion 3195 or 3196 can be passed down either 3094*c* or 3094*d* and turned past one of the necks 3095*b* or 3095*c* into bay 3098*b* where it will be held.

Figure 3R:
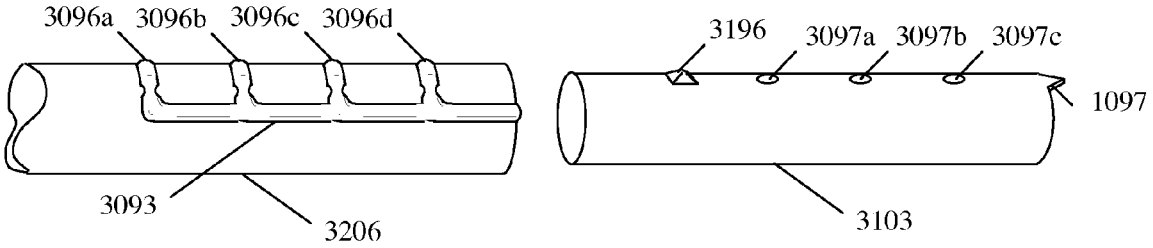

FIG. 3R illustrates a graduated channeled receiving end 3206 have a plurality of channel legs (shown as 3096*a* through 3096*d*). A corresponding graduated sleeve 3103 is also shown with an outward protrusion 3196 which can be inserted into the graduated channeled receiving end 3206 and locked into any of the channel legs (3096*a* through 3096*d*, respectively) to vary the length of a segmented shaft 107. In addition to the indicator 1097, the graduated sleeve 3103 has alternate indicators 3097*a* through 3097*c* that show the user the position of the outward protrusion 3196 when inserted into the graduated channeled receiving end 3206. For example, if the user wants to lock the outward protrusion 3196 in the channel leg 3096*c*, the user would pass the outward protrusion down the channel until alternate indicator 3097*b* is even with the edge of the graduated channeled receiving end 3206 and then turn the two ends with a clockwise rotation until the outward protrusion 3196 locks into channel leg 3096*c*.

Figure 4A:
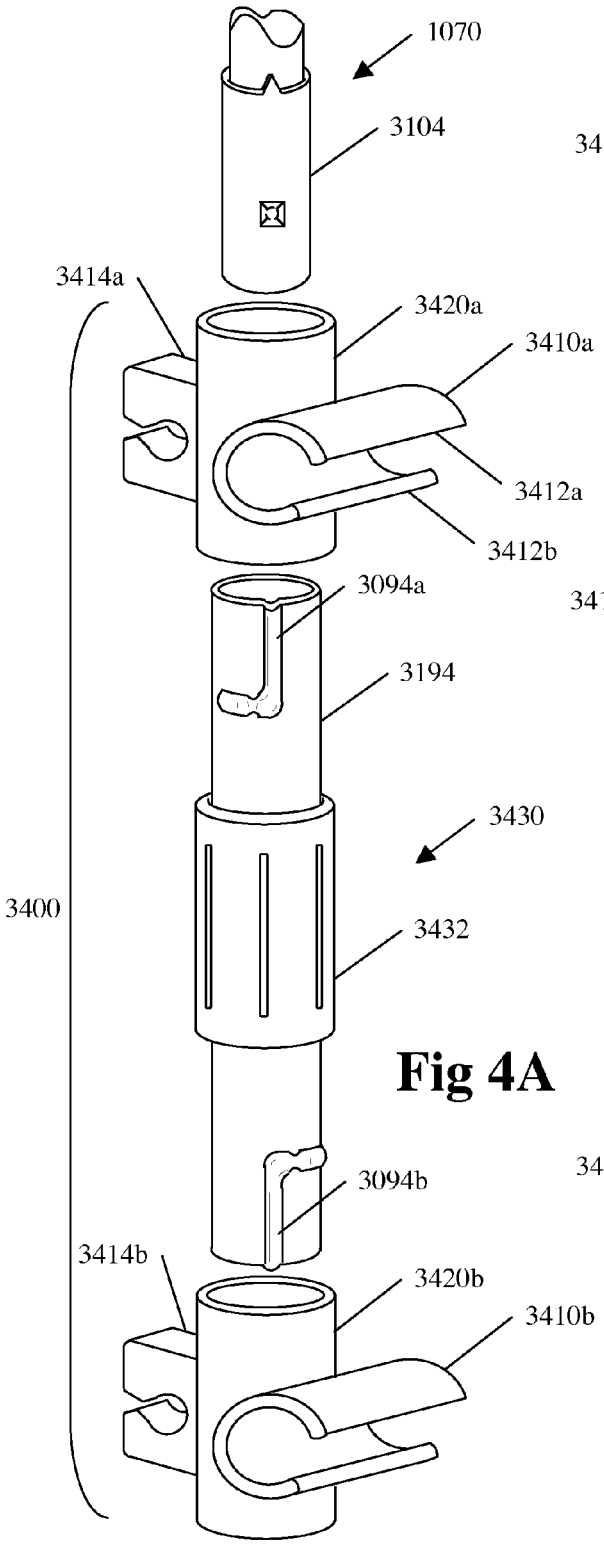
FIG. 4A through FIG. 4Z show various components that are connected using inward or outward protrusions.
Figure 4B:
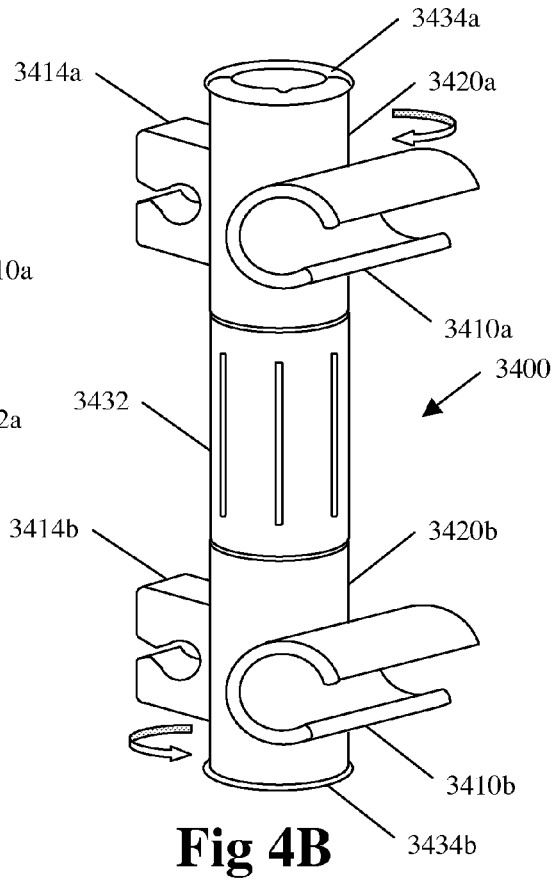
Figure 4C:
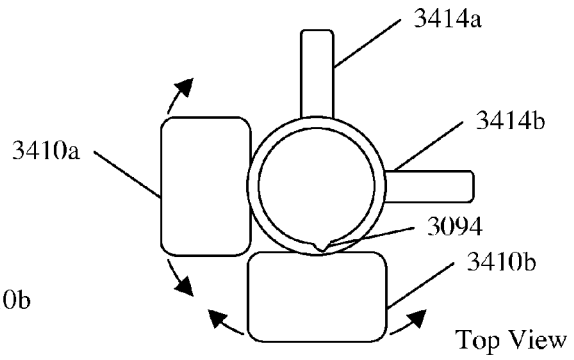

FIG. 4A Through FIG. 4C

FIG. 4A through FIG. 4C illustrate an embodiment of a dual-swivel clip 3400.

FIG. 4A shows an expanded view of the dual-swivel clip 3400 comprising two swivel clips 3420 rotatably mounted on a dual-swivel hub 3430. In this embodiment, each swivel clip 3420*a* and 3420*b*, respectively, comprises a pole clip 3410 and a cord clip 3414. Each pole clip 3410 comprises two pole clip members 3412*a* and 3412*b*, respectively, which are designed to clip and hold a pole (for example, see FIG. 7D). Each cord clip is designed to clip and hold a cord and is used to attach various covers or bow cords 1626 (as discussed in the ancestor applications). The dual-swivel hub 3430 is shown with a hub grip 3432. The dual-swivel hub 3430 is similar to the channeled connector 3194 (see FIG. 2C) having two locking channels 3094*a* and 3094*b*, respectively.

As shown in FIG. 4B, when assembled the swivel clips 3420*a* and 3420*b* are held in place by flared edge 3434*a* and 3434*b*, respectively. The flared edges 3434 are made by flaring each end of the dual-swivel hub 3430. Each of swivel clips 3420 rotate freely around the dual-swivel hub 3430, as shown by the rotational arrows in FIG. 4B and FIG. 4C (top view).

To make the configuration attachment, the user holds the hub grip 3432 and inserts the inserting end 1070 of a shaft segment (e.g. 3199) into the locking channel 3094 and rotates the inserting end 1070 clockwise. See FIG. 8D for an example configuration.

FIG. 4D

Figure 4D:
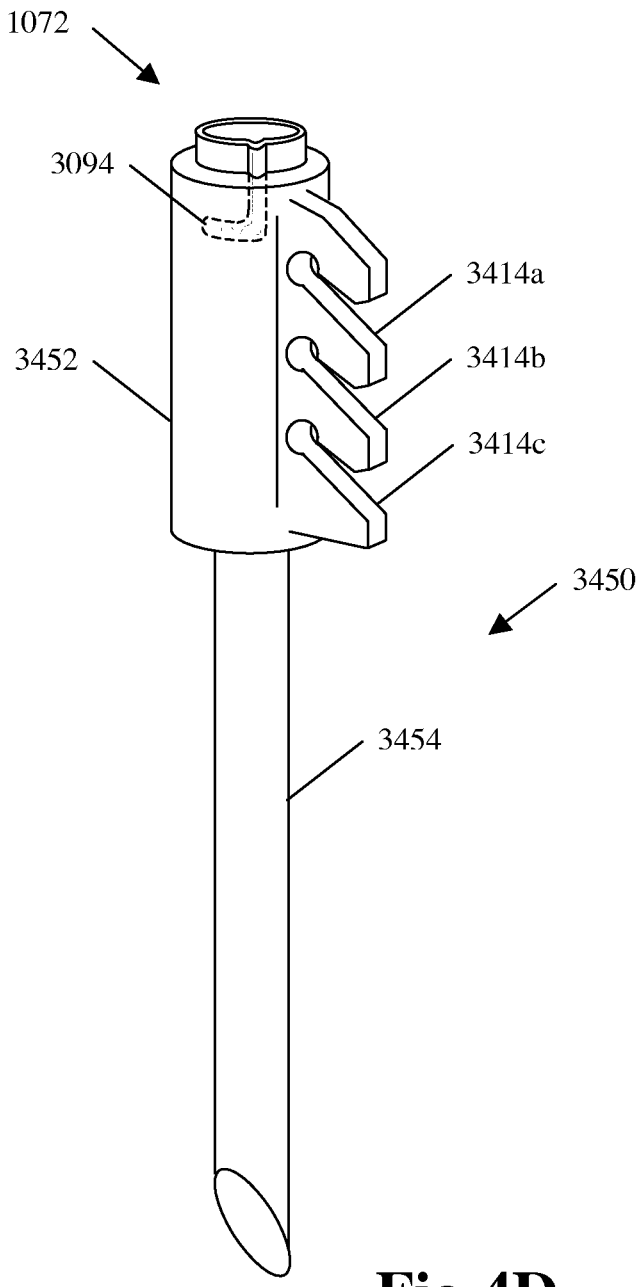

FIG. 4D shows a stake with cord clips 3450. The stake with cord clips 3450 comprises a receiving end with a locking channel 3094, a multiple cord clip member 3452, and a stake member 3454. The multiple cord clip member 3452 comprises a plurality of cord clips 3414.

FIG. 4E

Figure 4E:
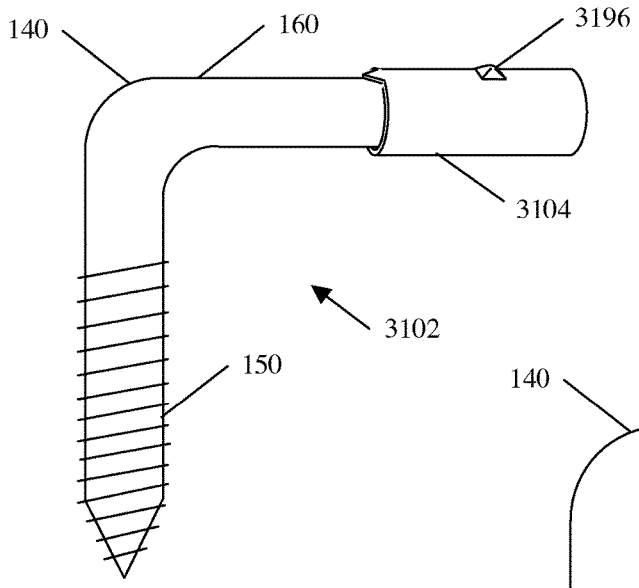

FIG. 4E shows the detail of the sleeved support 3102 (see FIG. 1C). The sleeved support 3102 is bent at an angle. The bend 140 results in two legs: a first leg 150 and a second leg 160. The first leg 150 has a threaded portion for threaded attachment to an attaching structure 130, such as a tree, pole, rock, wall, or attaching fastener 230 (as described in the ancestor applications). The second leg 160 comprises a sleeve 3104 having an outward protrusion 3196 (as shown, or 3195).

FIG. 4F

Figure 4F:
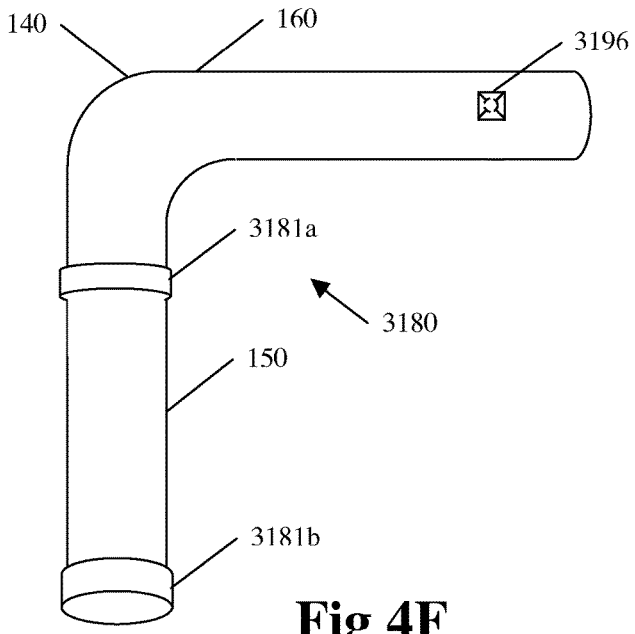
Figure 6A:
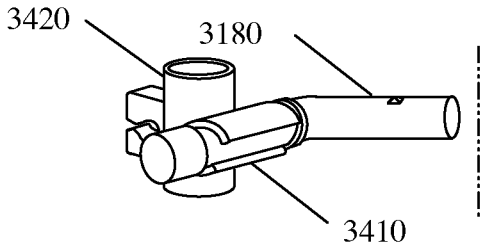
FIG. 6A through FIG. 6D shows one embodiment of a base segmented shaft.
Figure 6B:
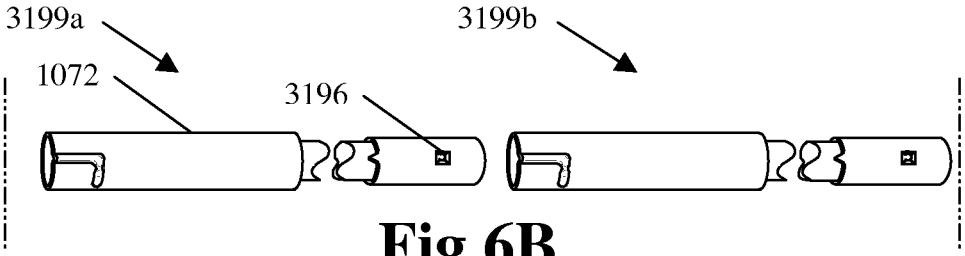
Figure 6C:
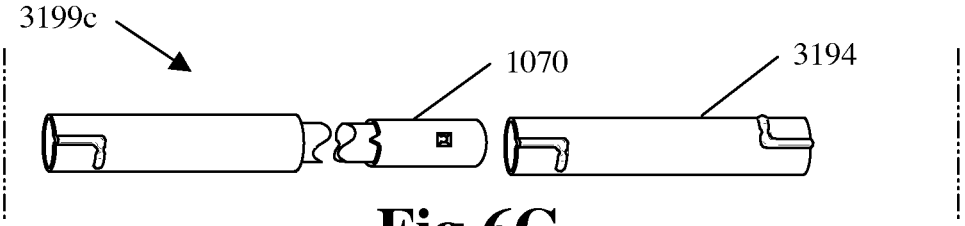
Figure 6D:
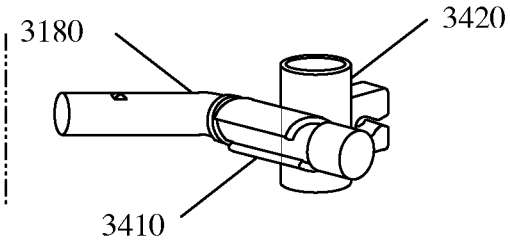

FIG. 4F shows a banded support 3180. The banded support 3180 is bent at an angle. The bend 140 results in two legs: a first leg 150 and a second leg 160. The first leg 150 has a smooth portion with two retaining bands 3181*a* and 3181*b*, respectively. The smooth portion is designed to clip into a pole clip 3410 as shown in FIG. 6A, FIG. 6D, and FIG. 8D. The retaining bands 3181 stop the banded support 3180 from slipping out of the pole clip 3410. The second leg 160 has an outward protrusion 3196 (as shown, or 3195) which can lock in any locking channel 3094. For example, in FIG. 8D, several banded supports 3180 are used to make the swivel connections for the base poles 3600 (FIG. 6A through 6D).

FIG. 4G Through FIG. 4J

Figure 4G:
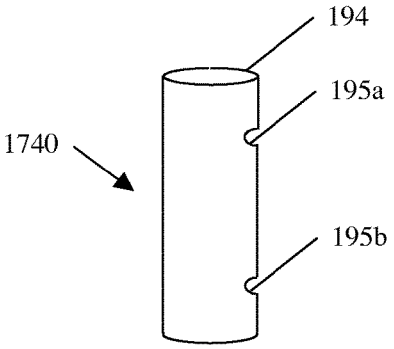
Figure 4H:
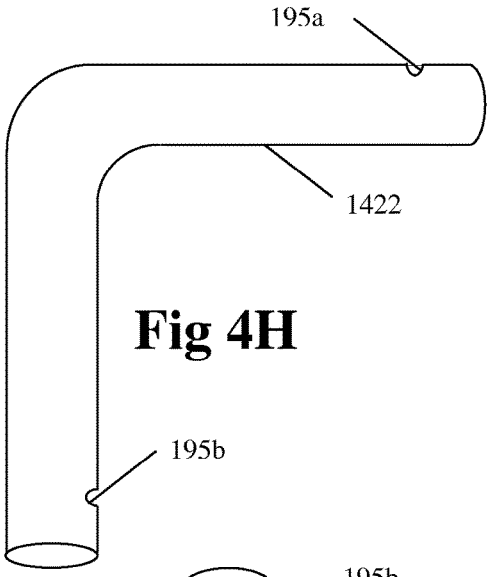

FIG. 4G shows a dimpled connector 194 with at least one inward protrusion on each end forming a receiving-to-receiving connector 1740. The receiving-to-receiving connector 1740 can connect any two slotted or threaded inserting ends 1070.

FIG. 4G shows an angled two-way receiving connector 1422. The angled two-way receiving connector 1422 can connect any two slotted or threaded inserting ends 1070.

Figure 4I:
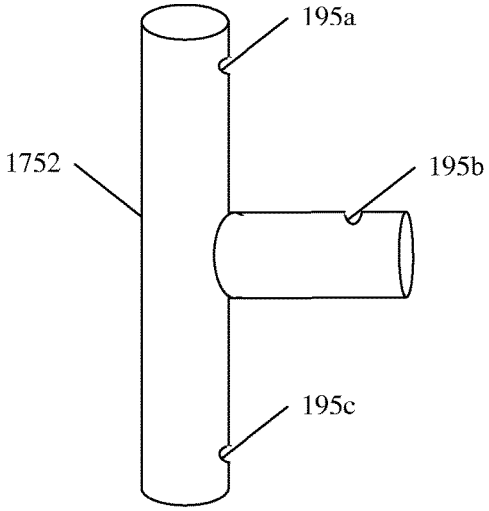

FIG. 4I shows a 3-way receiving connector 1752, that is used to interconnect various modules such as the walls, curtains, and covers shown in the ancestor applications. The 3-way receiving connector 1752 has at least one inward protrusion 195 in each of the receiving ends.

Figure 4J:
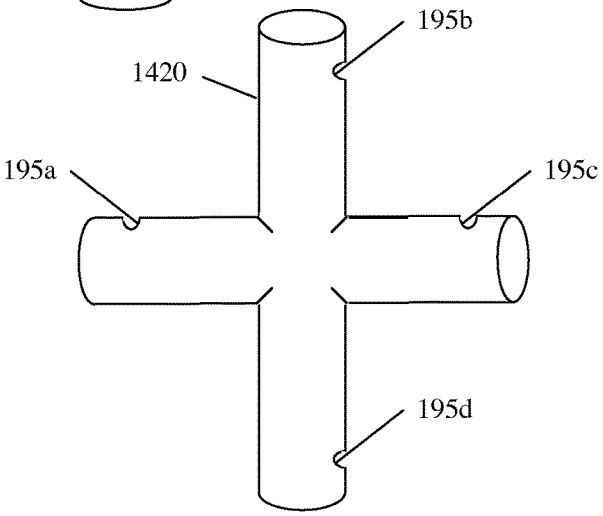

FIG. 4J shows a 4-way receiving end connector 1420. The 4-way receiving end connector 1420 has at least one inward protrusion 195 in each of the receiving ends that can connect any two or more slotted or threaded inserting ends 1070.

FIG. 4K Through FIG. 4P

Figure 4K:
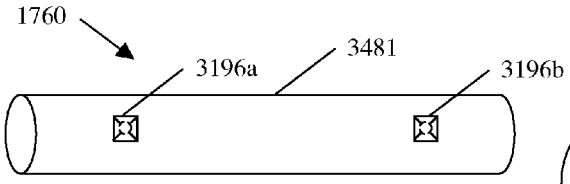

FIG. 4K shows a 2-way inserting end connector with protrusions 3481, which is an embodiment of an inserting-to-inserting connector 1760. The 2-way inserting end connector with protrusions 3481 can connect any two channeled receiving ends 1072.

Figure 4L:
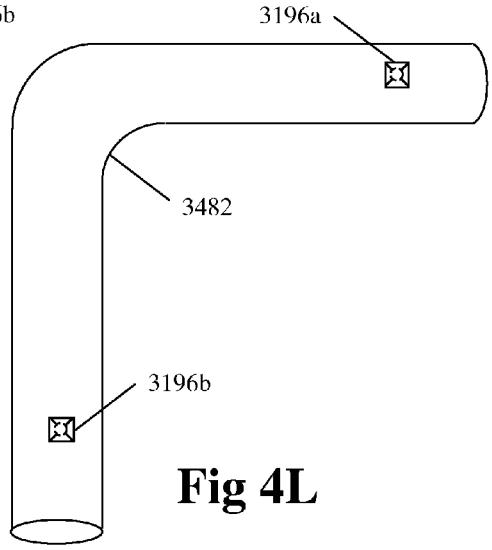

FIG. 4L shows an angled 2-way inserting end connector with protrusions 3482. The angled 2-way inserting end connector with protrusions 3482 can connect any two channeled receiving ends 1072.

Figure 4M:
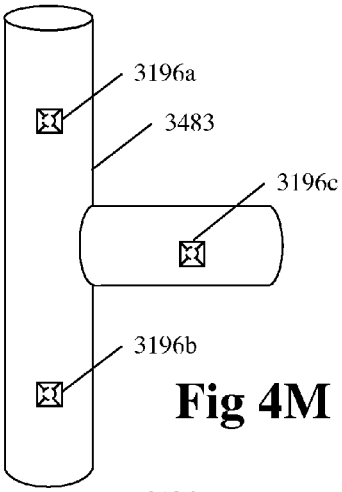

FIG. 4M shows a 3-way inserting end connector with protrusions 3483, that is used to interconnect various components to form various configurations. The 3-way inserting end connector with protrusions 3483 can connect two or three channeled receiving ends 1072.

Figure 4N:
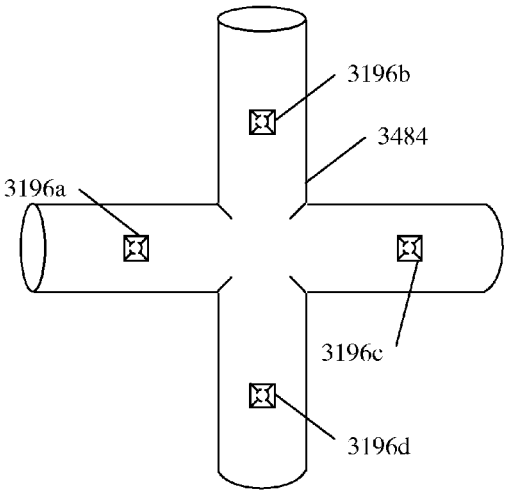

FIG. 4N shows a 4-way inserting end connector with protrusions 3484, that is used to interconnect various components to form various configurations. The 4-way inserting end connector with protrusions 3484 can connect two or more channeled receiving ends 1072.

Figure 4O:
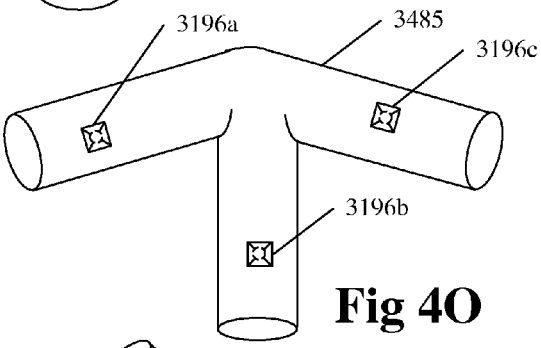

FIG. 4O shows a 3-way inserting end corner connector with protrusions 3485, that is used to interconnect various components to form a corner in a configuration. The 3-way inserting end corner connector with protrusions 3485 can connect two or more channeled receiving ends 1072.

Figure 4P:
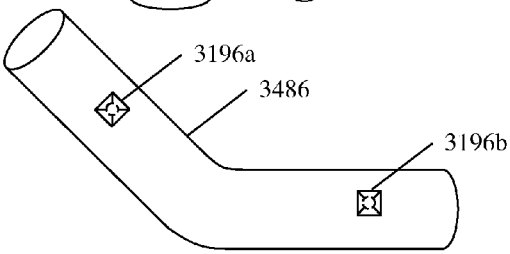

FIG. 4P shows an obtuse 2-way inserting end connector with protrusions 3486, that is used to interconnect various components to form an obtuse angle in a configuration. The obtuse 2-way inserting end connector with protrusions 3486 can connect any two channeled receiving ends 1072.

FIG. 4Q Through FIG. 4U

Figure 4Q:
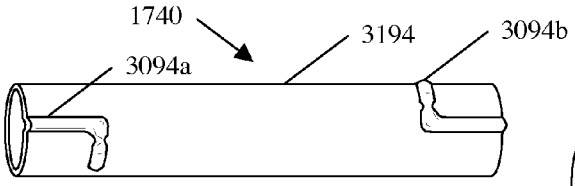

FIG. 4Q shows a 2-way receiving end connector with channels, a channeled connector 3195, which is an embodiment of a receiving-to-receiving connector 1740. See the discussion regarding FIG. 2C.

Figure 4R:
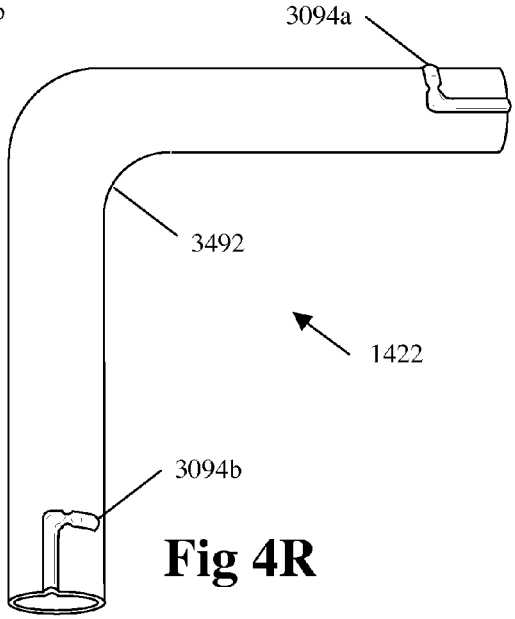

FIG. 4R shows an angled 2-way receiving end connector with channels 3492. The angled 2-way receiving end connector with channels 3492 can connect any two inserting ends with outward protrusions (3195 or 3196).

Figure 4S:
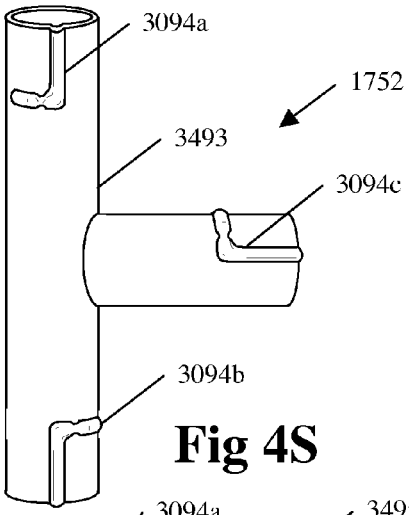

FIG. 4S shows a 3-way receiving end connector with channels 3493, that is used to interconnect various components to form various configurations. The 3-way receiving end connector with channels 3493 can connect two or two inserting ends with outward protrusions (3195 or 3196).

Figure 4T:
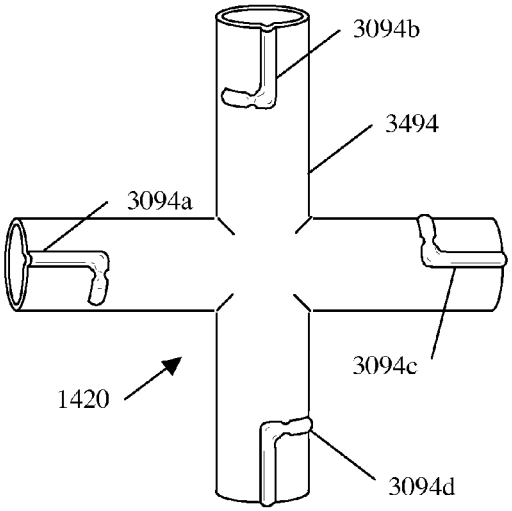

FIG. 4T shows a 4-way receiving end connector with channels 3494, that is used to interconnect various components to form various configurations. The 4-way receiving end connector with channels 3494 can connect two or two inserting ends 1070 with outward protrusions (3195 or 3196).

Figure 4U:
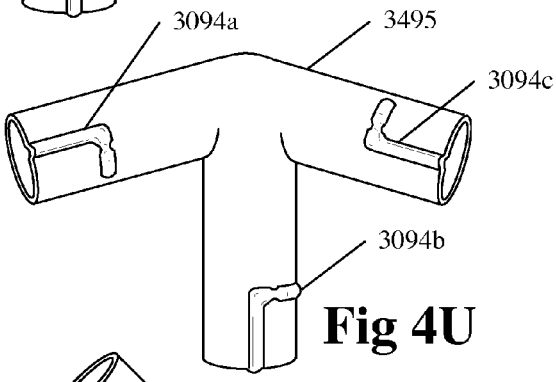

FIG. 4U shows a 3-way receiving end corner connector with channels 3495, that is used to interconnect various components to form a corner in a configuration. The 3-way receiving end corner connector with channels 3495 can connect two or more inserting ends 1070 with outward protrusions (3195 or 3196).

Figure 4V:
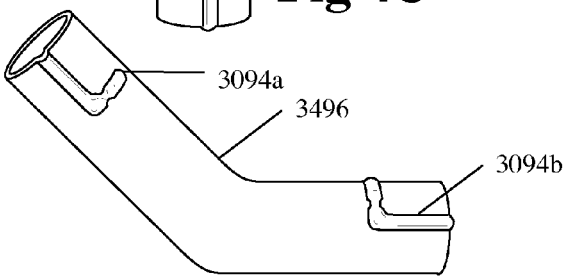

FIG. 4V shows an obtuse 2-way receiving end connector with channels 3496, that is used to interconnect various components to form an obtuse angle in a configuration. The obtuse 2-way obtuse 2-way receiving end connector with channels 3496 can connect any two inserting ends 1070 with outward protrusions (3195 or 3196).

FIG. 4W

Figure 4W:
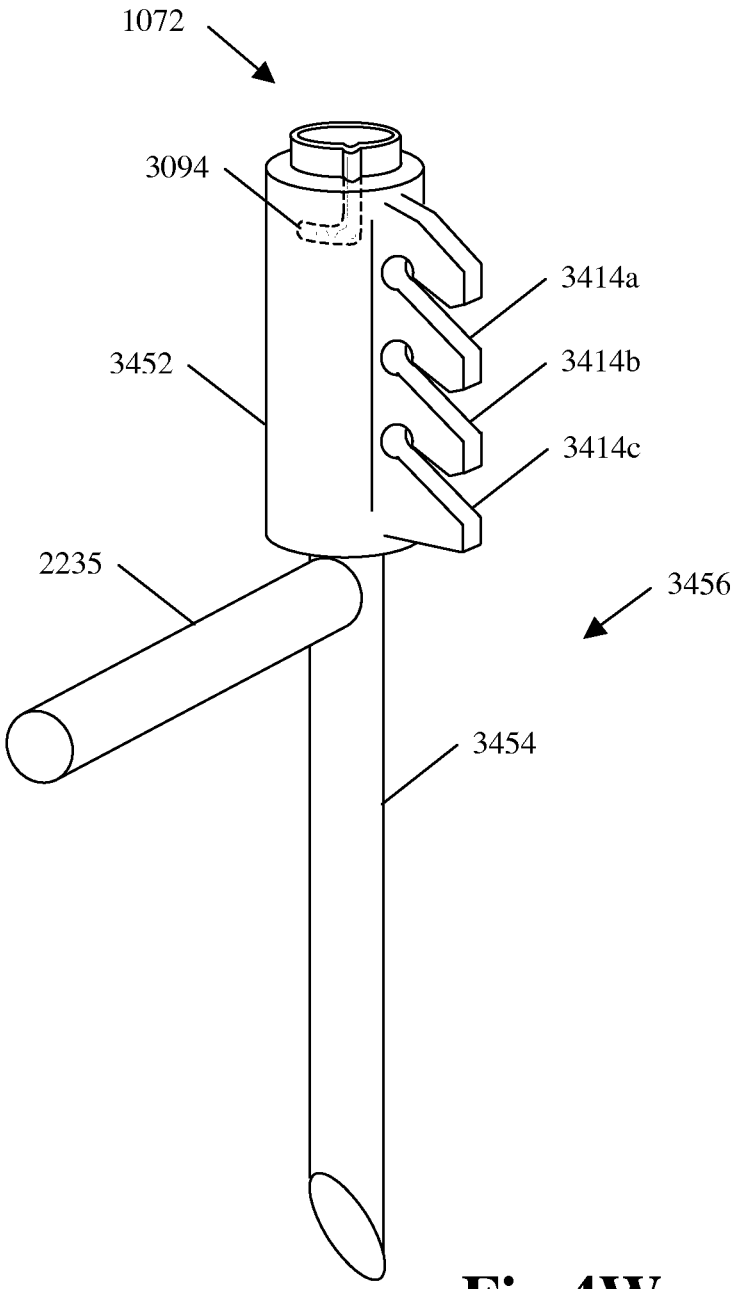

FIG. 4W shows a stake with cord clips and leg 3456. The stake with cord clips and leg 3456 comprises a receiving end with a locking channel 3094, a multiple cord clip member 3452, a stake member 3454, and a leg 2335. The multiple cord clip member 3452 comprises a plurality of cord clips 3414.

The stake leg 2235 is used to force the stake member 3454 into the ground; the stake leg 2235 may also be used to remove the stake 3456 from the ground.

Figure 4X:
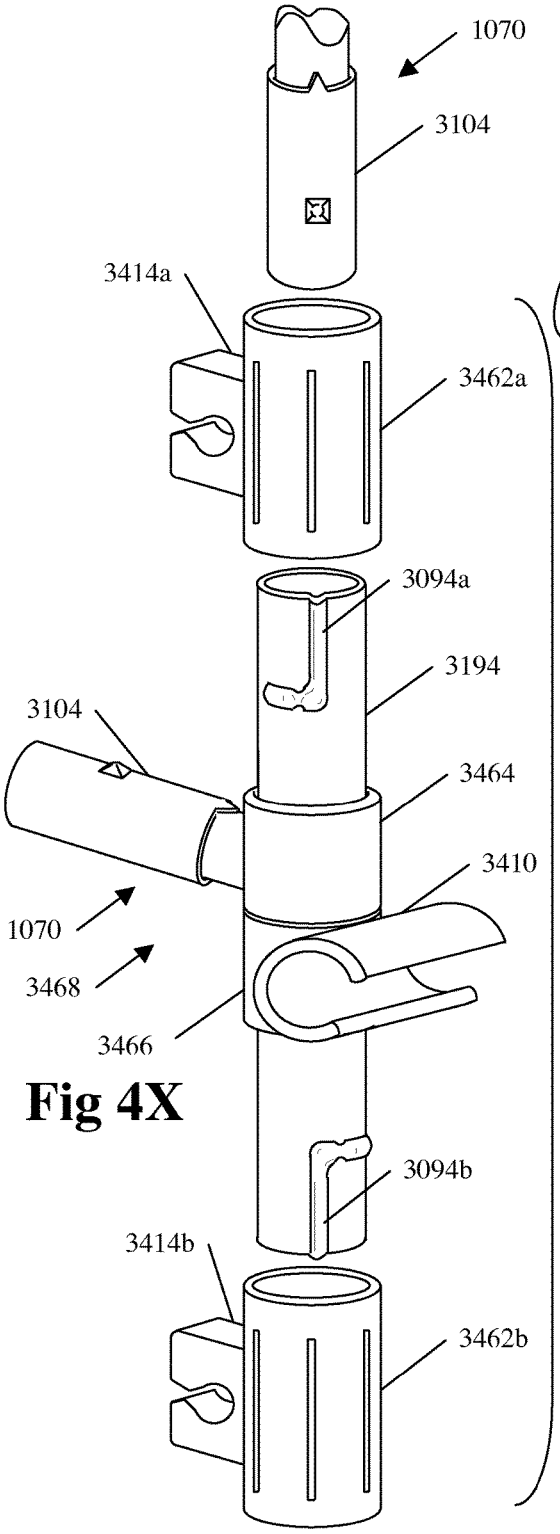
Figure 4Y:
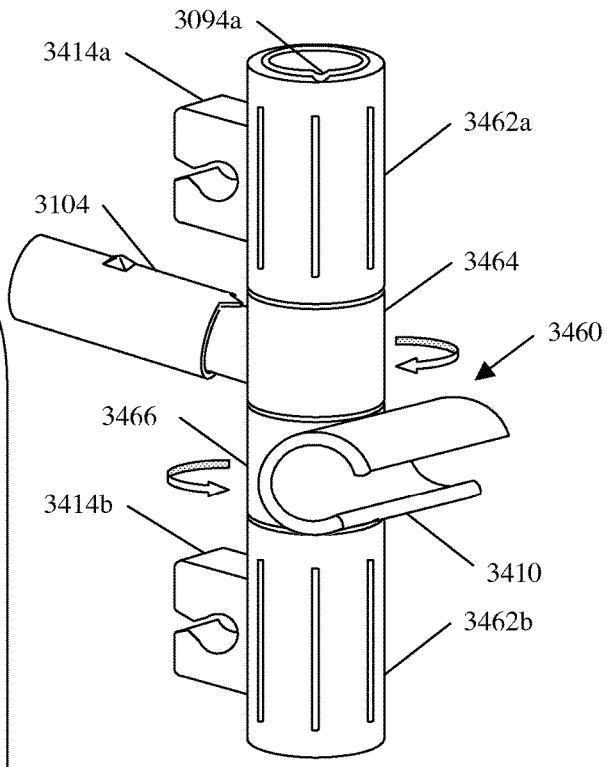
Figure 4Z:
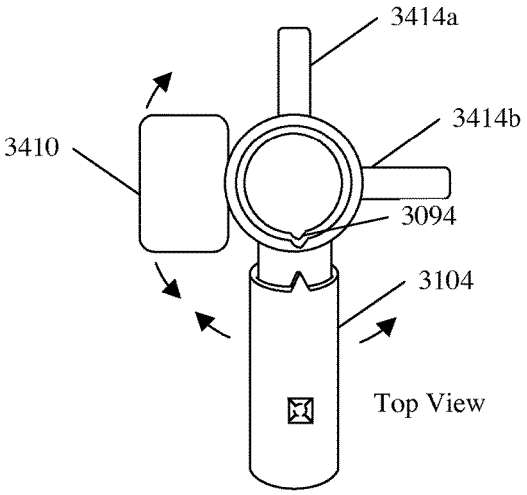

FIG. 4X Through FIG. 4Z

FIG. 4X through FIG. 4Z illustrate an embodiments of a currently preferred, alternate dual-swivel clip 3460.

FIG. 4X shows an expanded view of the alternate dual-swivel clip 3460 comprising two fixed cord clips 3462, an inserting end swivel 3464 rotatably mounted on an alternate dual-swivel hub 3468, and an alternate swivel clip 3466 also rotatably mounted on an alternate dual-swivel hub 3468. In this embodiment, the fixed cord clips 3462 are permanently attached to the alternate dual-swivel hub 3468 and hold the inserting end swivel 3464 and the alternate swivel clip 3466 between them. The alternate swivel clip 3466 comprises a pole clip 3410 that is designed to clip and hold a pole (as shown FIG. 7D). The fixed cord clips 3462 have a gripping surface. The alternate dual-swivel hub 3468 is similar to the channeled connector 3194 (see FIG. 2C) having two locking channels 3094*a* and 3094*b*, respectively.

As shown in FIG. 4Y, when assembled the inserting end swivel 3464 and the alternate swivel clip 3466 are held in place between the fixed cord clips 3462*a* and 3462*b*, respectively. The inserting end swivel 3464 and the alternate swivel clip 3466 rotate freely around the alternate dual-swivel hub 3468, as shown by the rotational arrows in FIG. 4Y and FIG. 4Z (top view).

To make the configuration attachment, the user holds the grip on one of the fixed cord clips 3462 and inserts the inserting end 1070 of a shaft segment (e.g. 3199) into the locking channel 3094 and rotates the inserting end 1070 clockwise. See FIG. 8F for an example configuration.

FIG. 5A Through FIG. 5E

FIG. 5A through FIG. 5E illustrate embodiments of a pivoting intersection connector 3500.

Figure 5A:
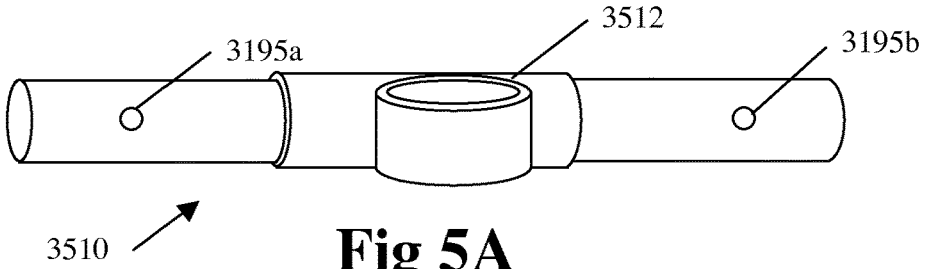
FIG. 5A through FIG. 5E show an embodiment of a pivoting intersection connector.
Figure 5B:
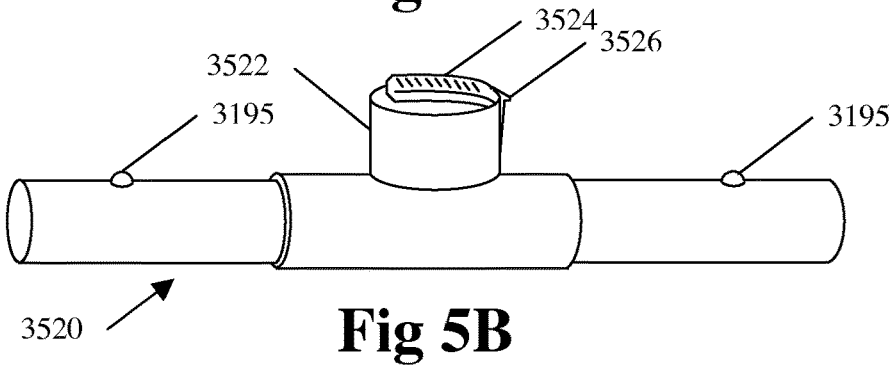
Figure 5C:
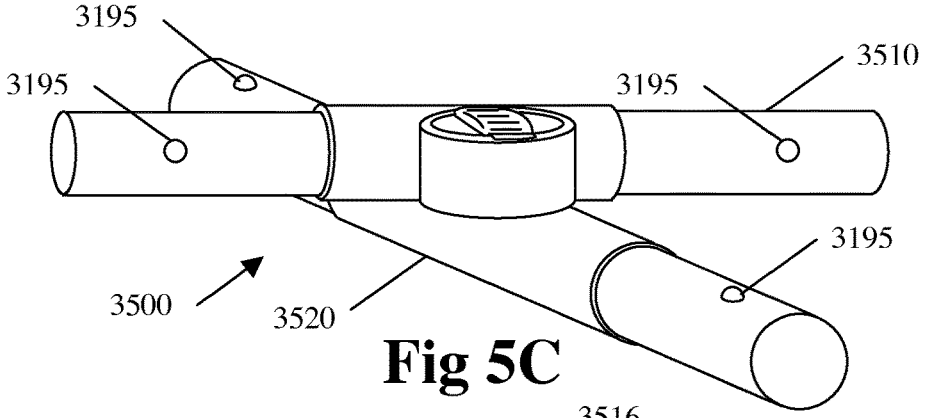

FIG. 5A shows an intersection member with band 3510, which is an embodiment of an inserting-to-inserting connector 1760 having an intersection band 3512 which operates with a intersection member with hub 3520 (FIG. 5B) to form a pivoting intersection connector 3500 (FIG. 5C).

FIG. 5B shows the intersection member with hub 3520, which is an embodiment of an inserting-to-inserting connector 1760 having an intersection hub 3522. The intersection hub 3522 comprises an intersection latch 3526. The intersection latch 3526 has a latch thumb grip 3524. The intersection hub 3522 may be removably attached through the intersection band 3512 (FIG. 5A). The intersection latch 3526 clips over the top of the intersection band 3512 and locks the two members (3510 and 3520) together to form the a pivoting intersection connector 3500 as shown in FIG. 5C.

As shown in FIG. 5C, while connected, the two members (3510 and 3520) are capable of pivoting to any angle. The user may disconnect the two members (3510 and 3520) by applying an inward pressure on the latch thumb grip 3524 until the intersection latch 3526 moves inside, and releases, the intersection band 3512.

Figure 5D:
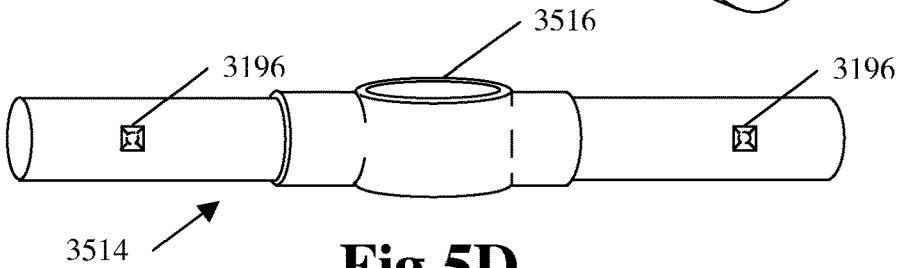
Figure 5E:
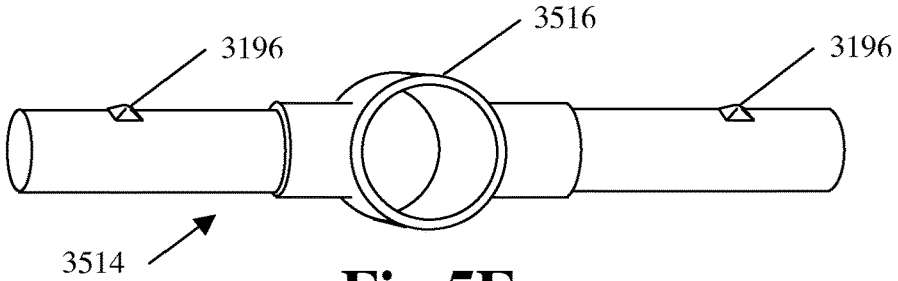

FIG. 5D and FIG. 5E show two views of an alternate embodiment of the intersection member with band 3510, a intersection member with alternate band 3514. The intersection member with alternate band 3514 has an alternate band 3516 symmetrically centered. The intersection member with alternate band 3514 (instead of member 3510) joins with intersection member with hub 3520 and operates in a similar manner.

FIG. 5F Through FIG. 5I

FIG. 5F through FIG. 5I illustrate embodiments of various components that may be used to form corners, especially base corners, in various pole configurations.

Figure 5F:
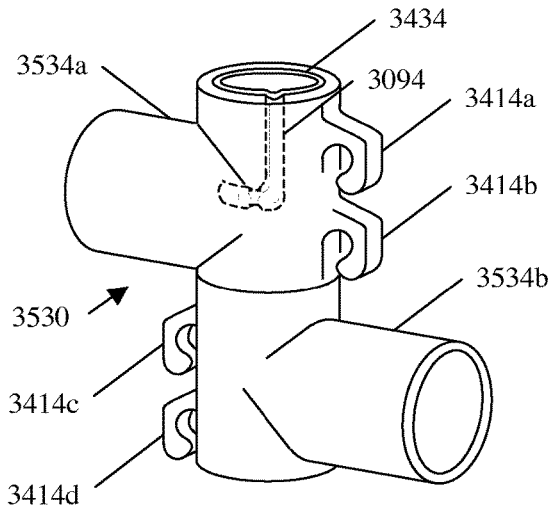
FIG. 5F through FIG. 5O show various components that are used as corner components.

FIG. 5F shows a dual-swivel pole receptacle 3530. The dual-swivel pole receptacle 3530 comprises two swivel members rotatably mounted on a channeled connector 3194 having a flared edge 3434. Each swivel member comprises a pole receptacle 3534 and a plurality of cord clips 3414. In this embodiment, each pole receptacle 3534*a* and 3434*b*, respectively, is large enough to loosely receive either an inserting end 1070 or a receiving end 1072 of the largest diameter shaft segment in the pole system. The cord clips 3414*a* through 3414*d* allow for different levels of tightness on a cord that is attached. For, example, a cord in a corner of a cover 1540 (not shown) may be attached to any of the cord clips 3414*a* through 3414*d*. If the fabric of the cover 1540 stretches through the heat of the day, the slack can be taken up by lowering the corner cord attachment, for example, from 3414*a* to 3414*d*. The locking channel 3094 is used to make a configuration attachment to any inserting end 1070 with an outward protrusion (3195 or 3196), for example, of a shaft segment (3197 or 3199) as shown in FIG. 8A.

Figure 5G:
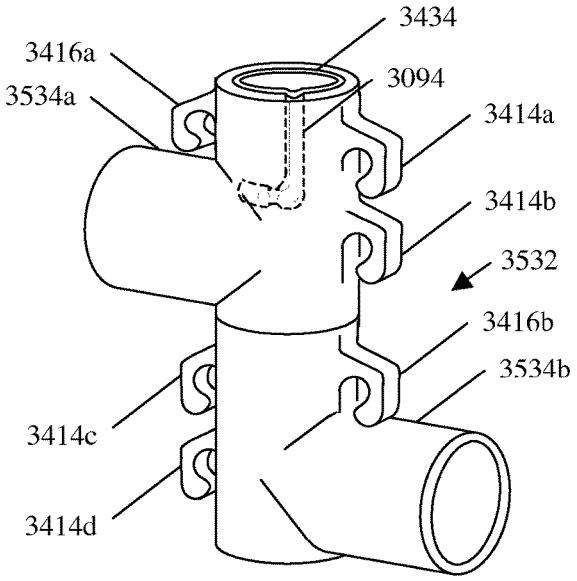

FIG. 5G shows an alternate embodiment of the dual-swivel pole receptacle 3530, an alternate dual-swivel pole receptacle 3532. The alternate dual-swivel pole receptacle 3532 further comprises a bow cord clip 3416 opposite the cord clips 3414 on each swivel member. The bow cord clip 3416 provides a bow cord attachment 1574 (as shown in application Ser. No. 11/295,305).

Figure 5H:
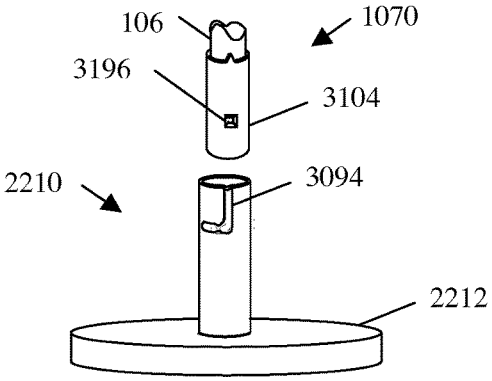

FIG. 5H shows a receiving base 2210 having a base plate 2212. The locking channel 3094 is used to make a configuration attachment to any inserting end 1070 with an outward protrusion (3195 or 3196), for example, of a shaft segment (3197 or 3199) as shown in FIG. 8A.

Figure 5I:
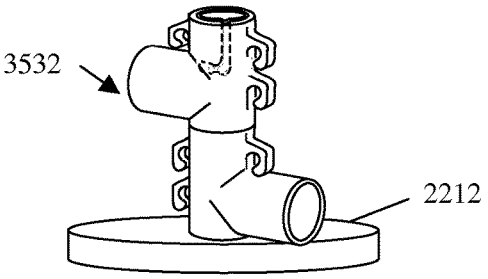

FIG. 5I shows an embodiment of the alternate dual-swivel pole receptacle 3532 mounted on a base plate 2212. Note that a similar component could be assembled using an alternate dual-swivel pole receptacle 3532 with a receiving end 1072 on the bottom and an inserting base 2220 (not shown).

FIG. 5J Through FIG. 5M

FIG. 5F through FIG. 5I illustrate embodiments of various adjustable brackets and corner bases having novel inserting ends 1070.

Figure 5J:
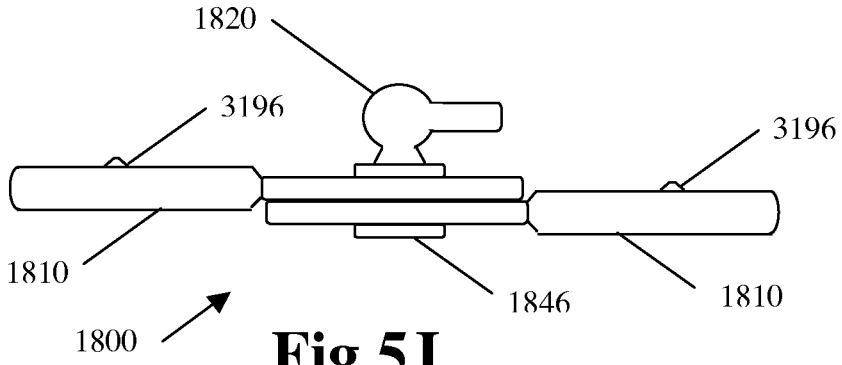

FIG. 5J shows a bracket leg 1810 that comprises embodiments of an adjustable bracket 1800. The adjustable bracket 1800 has an outward protrusion (3195, or preferably 3196) on each of a plurality of movable legs 1810.

As shown in FIG. 5J two bracket legs 1810 can be movably attached using a quick release 1820 attachment. A number of quick release devices are known in the art. The embodiment is shown using a bicycle quick release. When the lever of the quick release 1820 is raised the pressure on the bracket legs 1810 is released so that the legs can be moved to the desired angles. When the lever is lowered, the quick release tightens and holds the legs 1810 in their current positions.

Figure 5K:
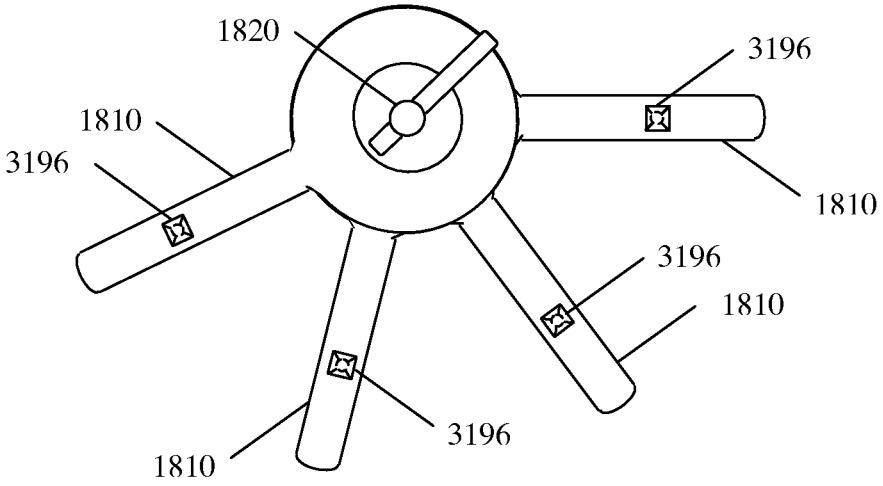

FIG. 5K shows the adjustable bracket 1800 with two more legs 1810 added. After the desired number of legs is added, the position of the legs can be adjusted quickly and locked into place with the quick release 120.

Like the inserting-to-inserting connector 1760, the adjustable bracket 1800 can connect any number of receiving ends 1072. Not all of the legs 1810 need to be used.

Figure 5L:
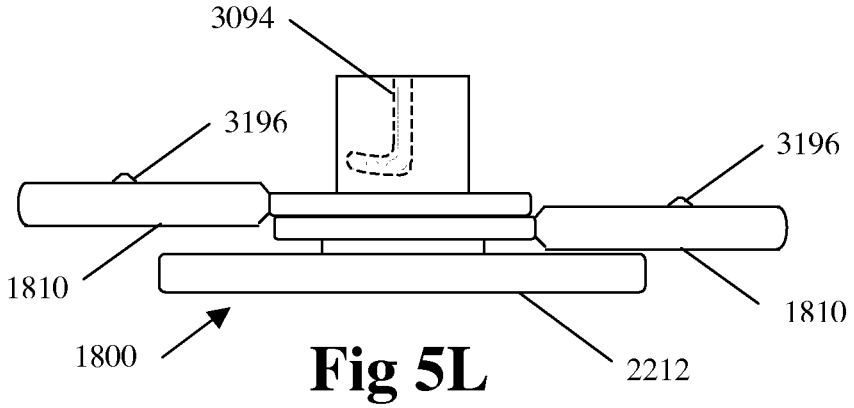
Figure 5M:
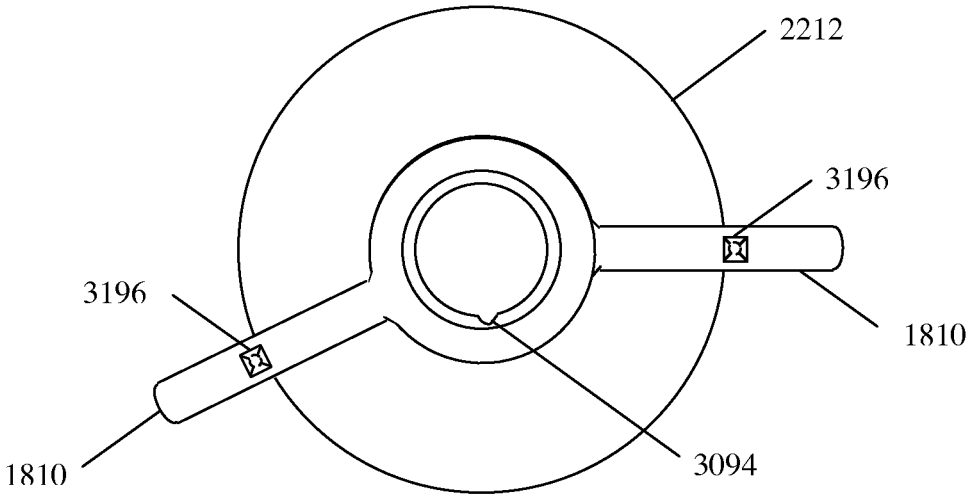

FIG. 5L and FIG. 5M show an alternate embodiment of the adjustable bracket 1800, namely alternate bracket 1802 mounted on a base plate 2212.

Figure 5N:
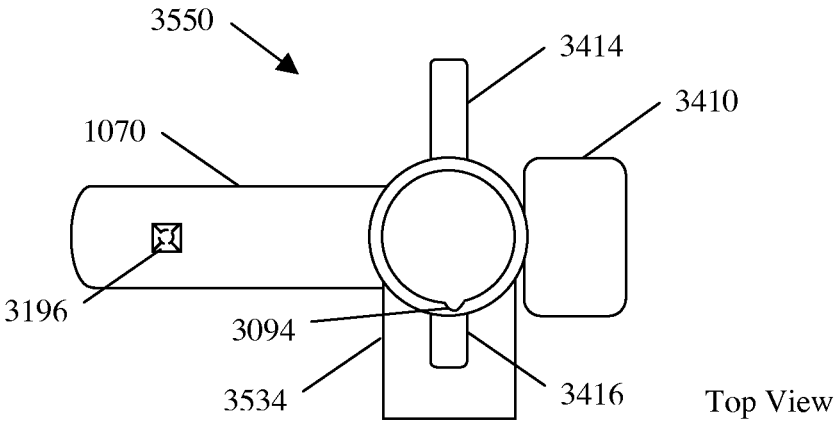
Figure 5O:
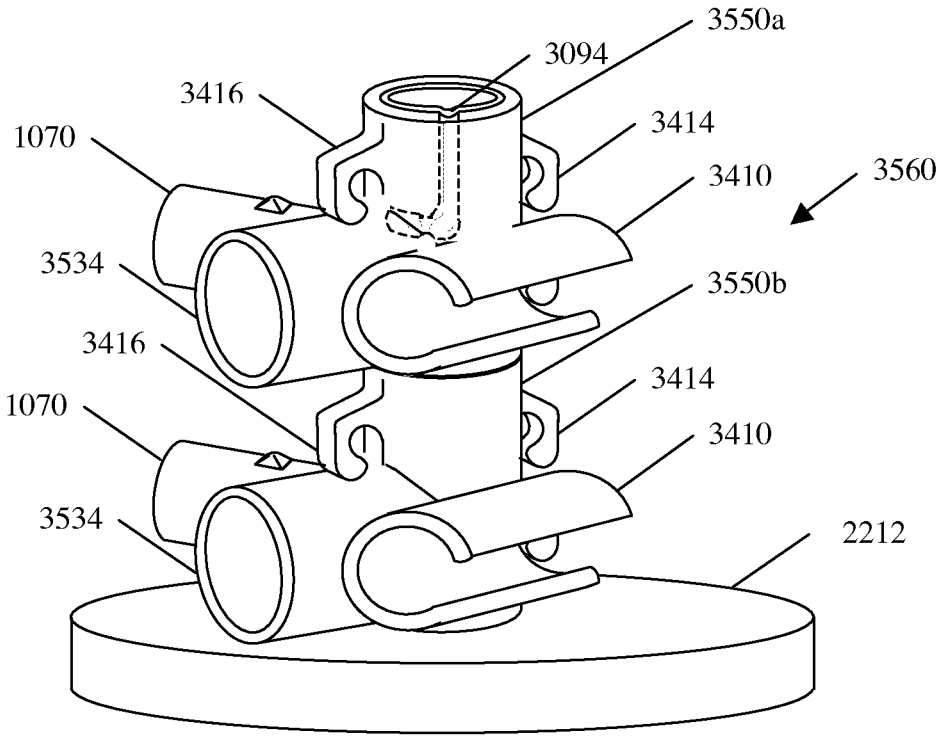

FIG. 5N and FIG. 5O

FIG. 5N shows a universal clip 3550 comprising a pole clip 3410, a cord clip 3414, an inserting end 1070 (shown with an outward protrusion 3196), a pole receptacle 3534, and a bow cord clip 3416. Each of these elements of the universal clip 3550 are described above in relation to FIG. 4X or 5G.

FIG. 5O shows a dual-universal clip base 3560 having two universal clips 3550*a* and 3550*b*, respectively, mounted on a receiving base 2210 shown comprising a base plate 2212 and a receiving end with a locking channel 3094. Each universal clip 3550 provide a variety of interconnection options for both shafts and cords. Each universal clip 3550 rotates freely around the underlying receiving base 2210.

FIG. 5P Through FIG. 5T

FIG. 5P through FIG. 5T illustrate alternate embodiments of a pivoting intersection connector 3500 having a means of pressure release to prevent breaking of segmented shafts.

Figure 5P:
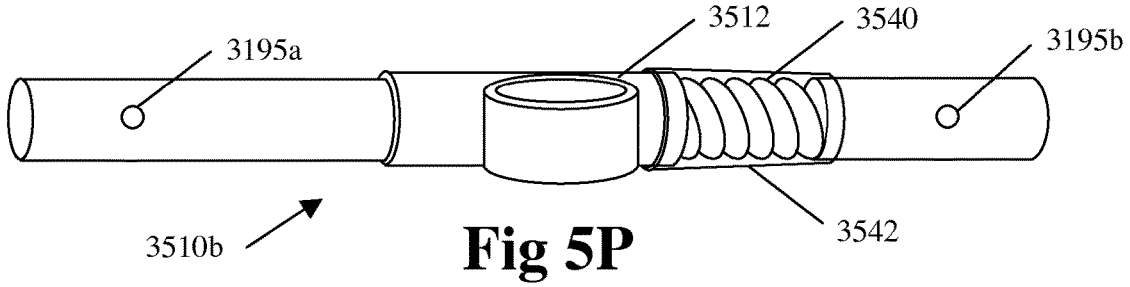
FIG. 5P through FIG. 5Z show various embodiments having a means of pressure release to prevent breaking of shafts.
Figure 5Q:
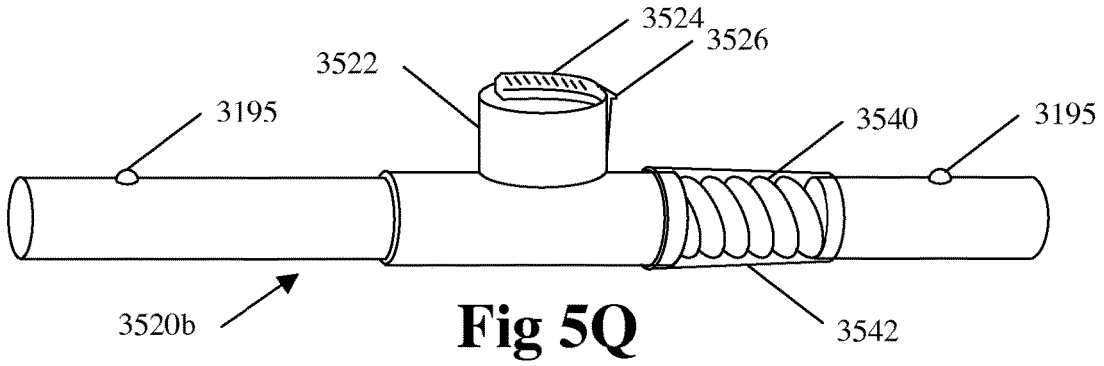
Figure 5R:
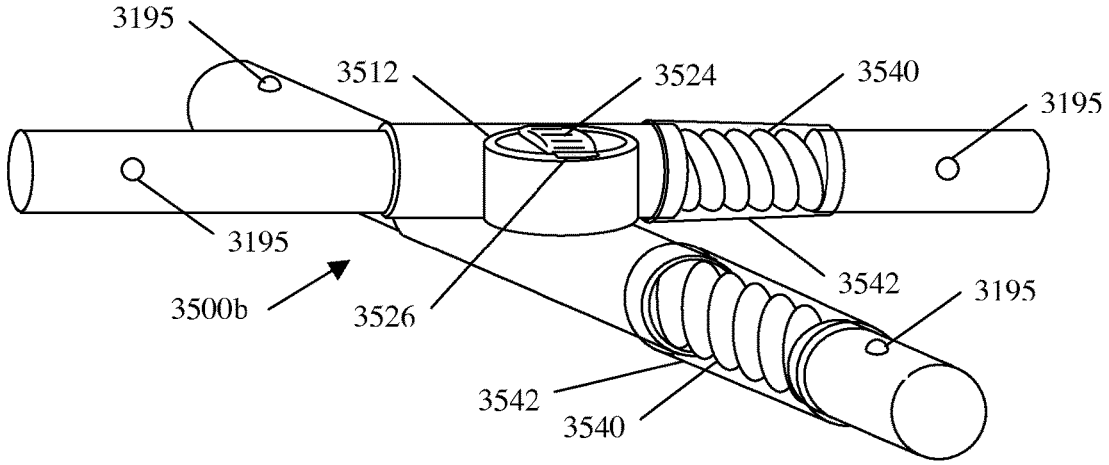

FIG. 5P shows an alternate intersection member with band 3510*b*, which is an embodiment of an inserting-to-inserting connector 1760 having an intersection band 3512 which operates with an alternate intersection member with hub 3520*b* (FIG. 5Q) to form a pivoting intersection connector 3500*b* (FIG. 5R). This alternate embodiment further includes a pressure release to prevent breaking of the segmented shafts when the user applies too much bend to an arch.

As shown in FIG. 5P through FIG. 5X and FIG. 5Z, the pressure release is a tightly wound, thick spring 3540 which holds the part straight during normal operation but, when the bending pressure exceeds a predetermined limit, will bend preventing any of the shaft segments from breaking. The pressure release spring 3540 is optionally covered with a protective sheath 3542 that prevents material (such as the cover 1540) from being caught in the coils of the bent spring (3540). Good results have been obtained by making protective sheath 3542 with a section of clear plastic tubing. A spring 3540 is a simple, low-cost means of pressure release. The means of pressure release could also be made in other ways, such as a short shaft 106 held to the intersection member 3510 with a pin and held in place with a spring-loaded latch. When the bending pressure exceeds the predetermined limit, the spring-loaded latch would release allowing the short shaft 106 to pivot about the pin.

FIG. 5Q shows the alternate intersection member with hub 3520*b*, which is an embodiment of an inserting-to-inserting connector 1760 having an intersection hub 3522. The intersection hub 3522 comprises an intersection latch 3526. The intersection latch 3526 has a latch thumb grip 3524. The intersection hub 3522 may be removably attached through the intersection band 3512 (FIG. 5P). The intersection latch 3526 clips over the top of the intersection band 3512 and locks the two members (3510*b* and 3520*b*) together to form an alternate pivoting intersection connector 3500*b* as shown in FIG. 5R.

As shown in FIG. 5R, while connected, the two members (3510*b* and 3520*b*) are capable of pivoting to any angle. The user may disconnect the two members (3510*b* and 3520*b*) by applying an inward pressure on the latch thumb grip 3524 until the intersection latch 3526 moves inside, and releases, the intersection band 3512.

Figure 5S:
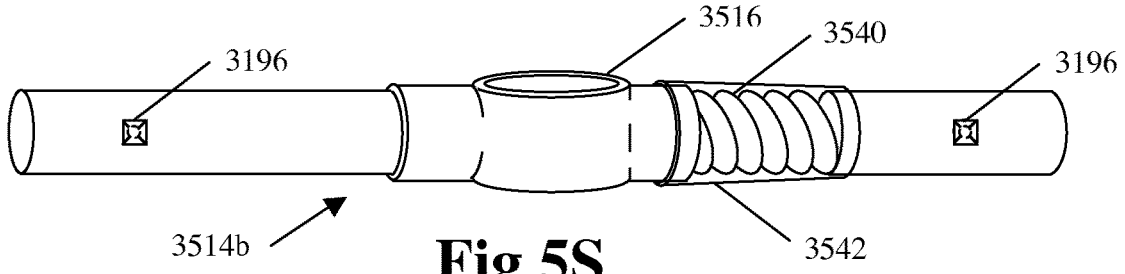
Figure 5T:
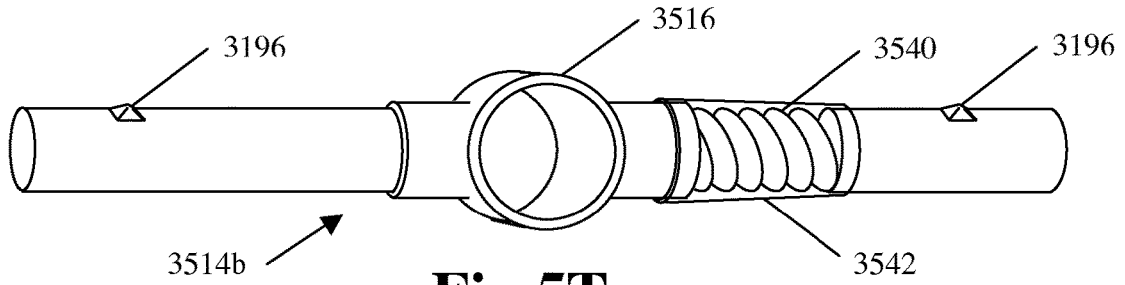

FIG. 5S and FIG. 5T show two views of another alternate embodiment of the intersection member with band 3510, an intersection member with alternate band 3514*b*. The intersection member with alternate band 3514*b* has an alternate band 3516 symmetrically centered. The intersection member with alternate band 3514*b* (instead of member 3510) joins with intersection member with hub 3520*b* and operates in a similar manner. This embodiment has the means of pressure release shown as a pressure release spring 3540 with optional protective sheath 3542.

Figure 5U:
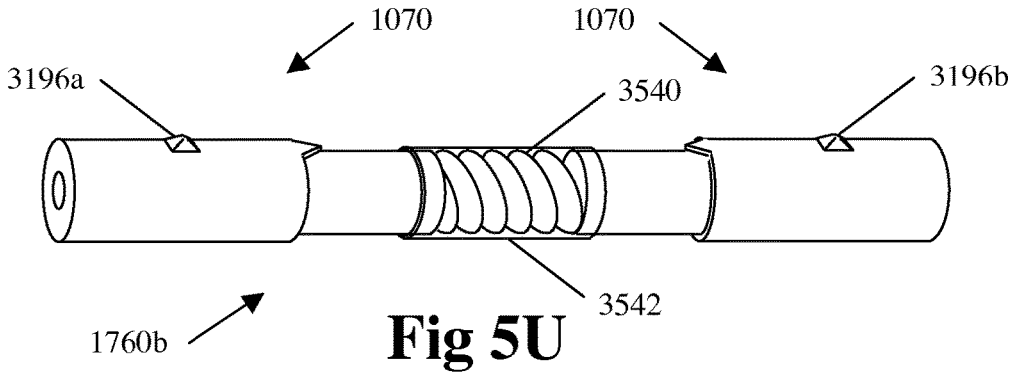
Figure 5V:
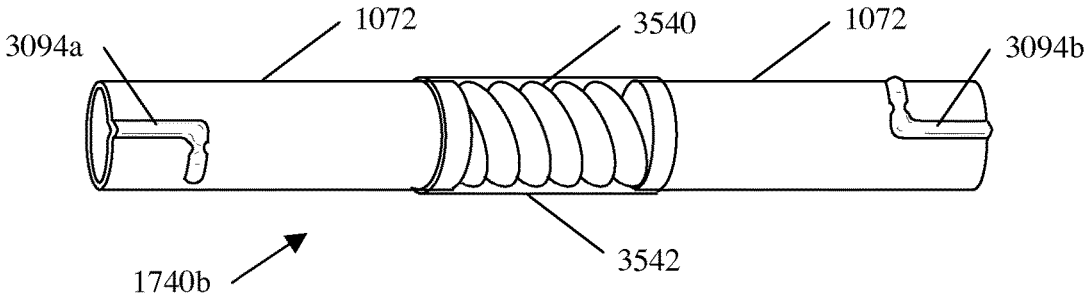

FIG. 5U and FIG. 5V

FIG. 5U and FIG. 5V illustrate alternate embodiments of connectors having a means of pressure release to prevent breaking of segmented shafts.

FIG. 5U shows an alternate inserting-to-inserting connector 1760*b* having two inserting ends connected by a means of pressure release, shown as a pressure release spring 3540 optionally covered with a protective sheath 3542. The pressure release prevents breaking of the segmented shafts when the user applies too much bend to an arch (as discussed above). This connector may be used in an arch that does not intersect with another arch at the top of the respective arches. See parent applications for various example configurations. The embodiment shown has an outward protrusion (3196*a* and 3196*b*, respectively) on each end.

FIG. 5V shows an alternate receiving-to-receiving connector 1740*b* having two receiving ends connected by a means of pressure release, shown as a pressure release spring 3540 optionally covered with a protective sheath 3542. The pressure release prevents breaking of the segmented shafts when the user applies too much bend to an arch (as discussed above). This connector may be used in an arch that does not intersect with another arch at the top of the respective arches. See parent applications for various example configurations. The embodiment shown has a receiving channel (3094*a* and 3094*b*, respectively) on each end.

FIG. 5W Through FIG. 5Z

FIG. 5W through FIG. 5Z illustrate various corner base connectors also having a means of pressure release to prevent breaking of segmented shafts.

Figure 5W:
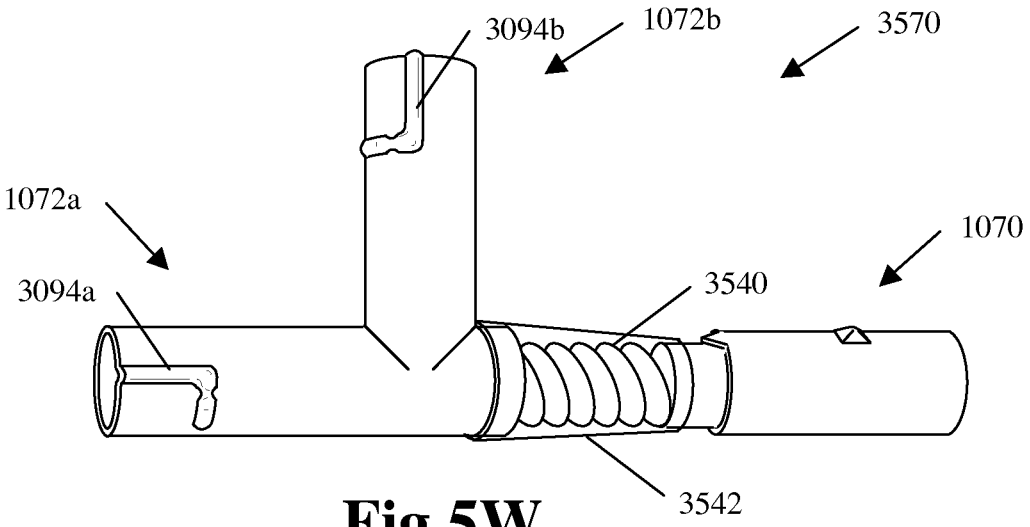

FIG. 5W shows a corner base connector 3570 having two receiving ends (1072*a* and 1072*b*, respectively) at a right angle, and an inserting end connected by a means of pressure release, shown as a pressure release spring 3540 optionally covered with a protective sheath 3542. The pressure release prevents breaking of the segmented shafts when the user applies too much bend to a base ring (FIG. 5Y). This connector may be used to configure a base structure which can receive a shaft in each corner as shown for example in FIG. 5Y. The embodiment shown has an outward protrusion on the inserting end and receiving channels (3094*a* and 3094*b*, respectively) on the receiving ends.

Figure 5X:
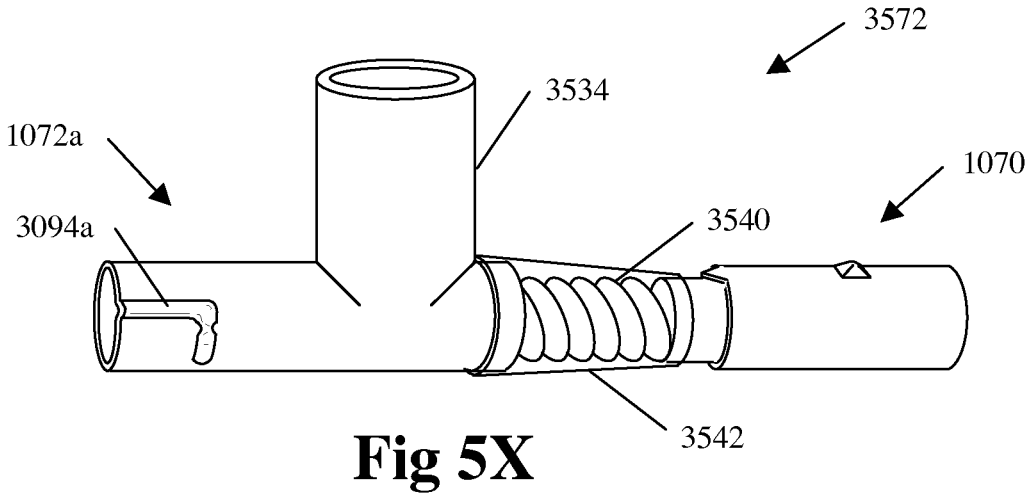
Figure 5Y:
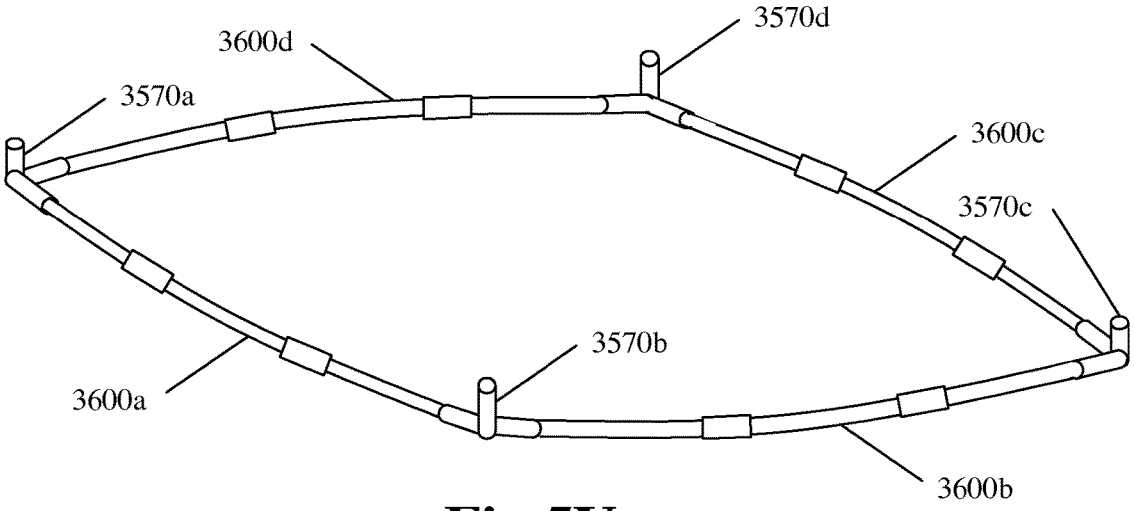

FIG. 5X shows an alternate corner base connector 3572 having one receiving end 1072*a* at a right angle with a pole receptacle 3534, and an inserting end connected by a means of pressure release, shown as a pressure release spring 3540 optionally covered with a protective sheath 3542. The embodiment shown has an outward protrusion on the inserting end and a receiving channel 3094*a* on the channeled receiving ends 1072*a*.

FIG. 5Y shows an exemplary base structure comprising a plurality of base segmented shafts (3600*a* through 3600*d*) connected by a plurality of base corner connectors (3570*a* through 3570*d*). The base structure is shown as a ring. This exemplarily base structure is capable of receiving two intersecting arches 3700 (FIG. 8A) (or two non-intersecting arches, see parent applications for such configurations). The base structure is useful for creating a free standing blind or structure for use on rocky ground (e.g. where it is difficult to insert a stake 3450 or 3456), pavement (e.g. flee market), or floor (e.g. trade show).

Figure 5Z:
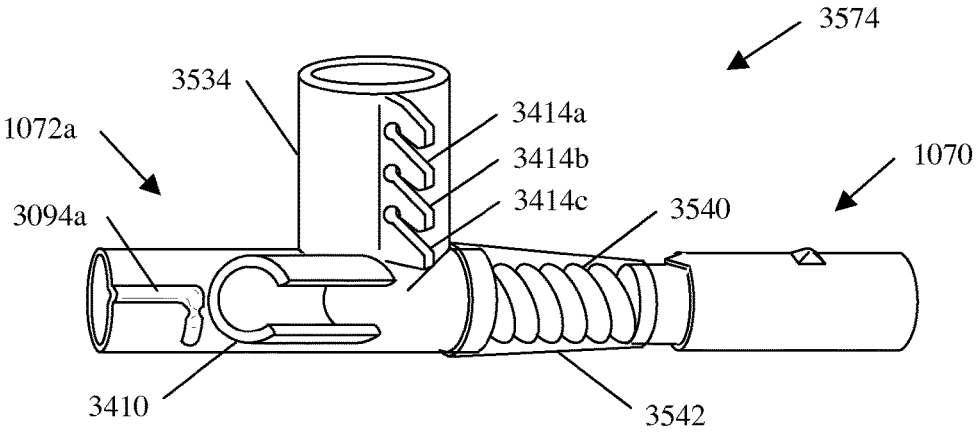

FIG. 5Z shows a corner base connector with clips 3574 having one receiving end 1072*a* at a right angle with a pole receptacle 3534, and an inserting end connected by a means of pressure release, shown as a pressure release spring 3540 optionally covered with a protective sheath 3542. The embodiment shown has an outward protrusion on the inserting end and a receiving channel 3094*a* on the channeled receiving ends 1072*a*. This embodiment further comprises a plurality of cord clips 3414 on the pole receptacle 3534 and a pole clip 3410 attached to the receiving end 1072*a*. The pole clip allows the user to adjust the circumference of the base structure (see discussion regarding FIG. 7D).

FIG. 6A Through FIG. 6D

FIG. 6A through FIG. 6D illustrate a single segmented base shaft with universal corner attachments. As shown by the dotted and dashed lines, FIG. 6A is connected to FIG. 6B which is connected to FIG. 6C which is connected to FIG. 6D. On each end, shown in FIG. 6A and FIG. 6D respectively, a banded support 3180 is attached to a pole clip 3410. The pole clip 3410 can be part of a swivel clip 3420 as shown in FIG. 4A and FIG. 4B or a similar component such as those shown, for example, in FIG. 4X and FIG. 4Y, FIG. 5O, or FIG. 5Z. The segmented base shaft is shown comprising three channeled shaft segments 3199*a* through 3199*c*) and a channeled connector 3194.

FIG. 7A Through FIG. 7D

Figure 7A:
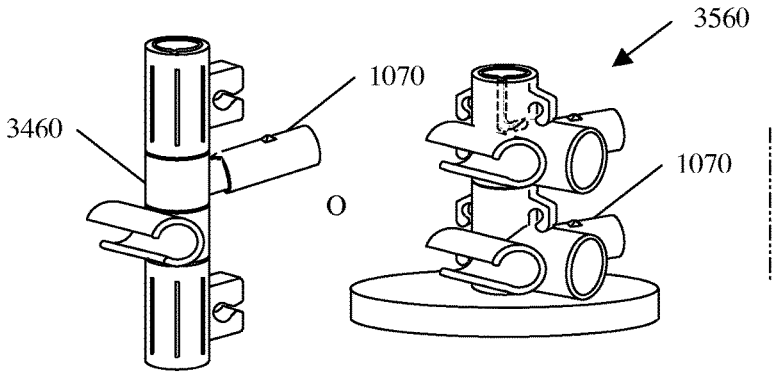
FIG. 7A through FIG. 7D shows another embodiment of a base segmented shaft.
Figure 7B:
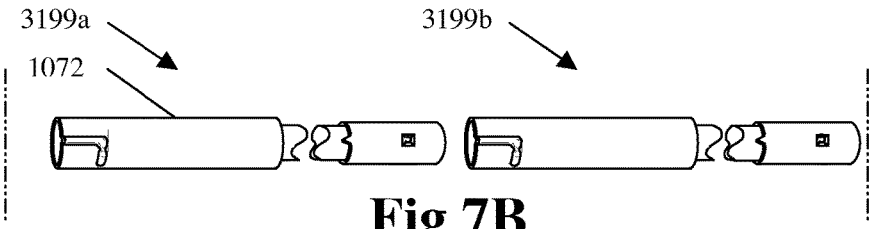
Figure 7C:
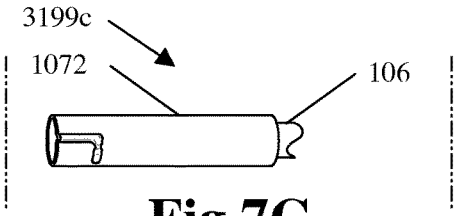
Figure 7D:
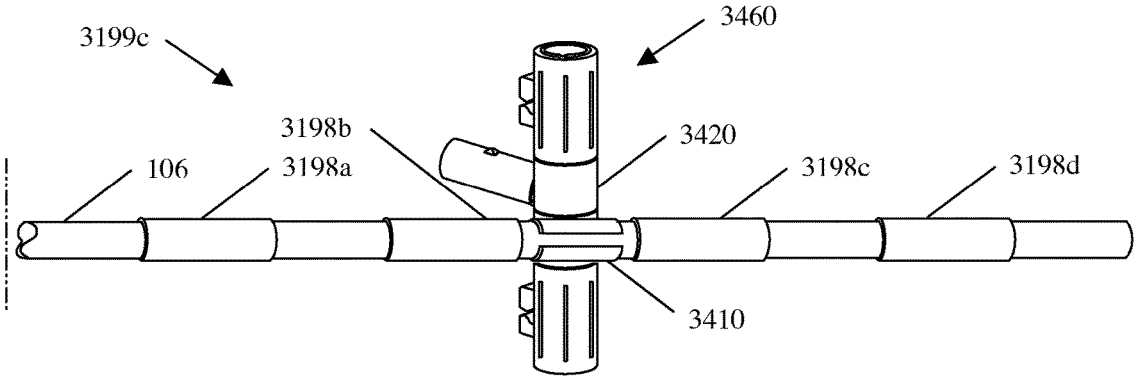

FIG. 7A through FIG. 7D illustrate a currently preferred alternate embodiment of a single segmented base shaft with universal corner attachments. As shown by the dotted and dashed lines, FIG. 7A is connected to FIG. 7B which is connected to FIG. 7C which is connected to FIG. 7D. On one end, shown in FIG. 7A, a corner component (shown as either an alternate dual-swivel clip 3460 or a dual-universal clip base 3560) comprises an inserting end 1070. At the other end, shown in FIG. 7D the corner component has a pole clip 3410 (shown for example as alternate dual-swivel clip 3460). The segmented base shaft is shown comprising three channeled shaft segments 3199*a* through 3199*c*). The last channeled shaft segment 3199*c* is shown in part in FIG. 7C. The remaining part of channeled shaft segment 3199*c* is shown in FIG. 7D and has a plurality of retaining sleeves (3198*a* through 3198*b*). The pole clip 3410 can be attached to the shaft segment 3199*c* and the shaft segment can be held in that position by the retaining sleeves 3198.

Good results have been obtained by making the retaining sleeves of a flexible plastic tubing having an inside diameter substantially equal to the outside diameter of the segmented shaft 3199. In one embodiment, the position of the retaining sleeve 3198 can be adjusted by the user. In another embodiment, a plurality of retaining sleeves can be fixed in place on the shaft 106 with glue. Good results have been obtained using a flexible glue such as Mr. Sticky (identified above).

FIG. 8A Through FIG. 8G

FIG. 8A illustrates a pair of pivoting arches 3700. The pair of pivoting arches 3700 comprises an embodiment of pivoting intersection connector 3500 (or 3500*b*) and a plurality of full-length channeled shaft segments 3199 or half-length shaft segments 3197. In a currently preferred embodiment, the pair of pivoting arches 3700 comprises three full-length channeled shaft segments 3199 and one half-length shaft segment 3197 on each side of each arch (as shown).

Figure 8B:
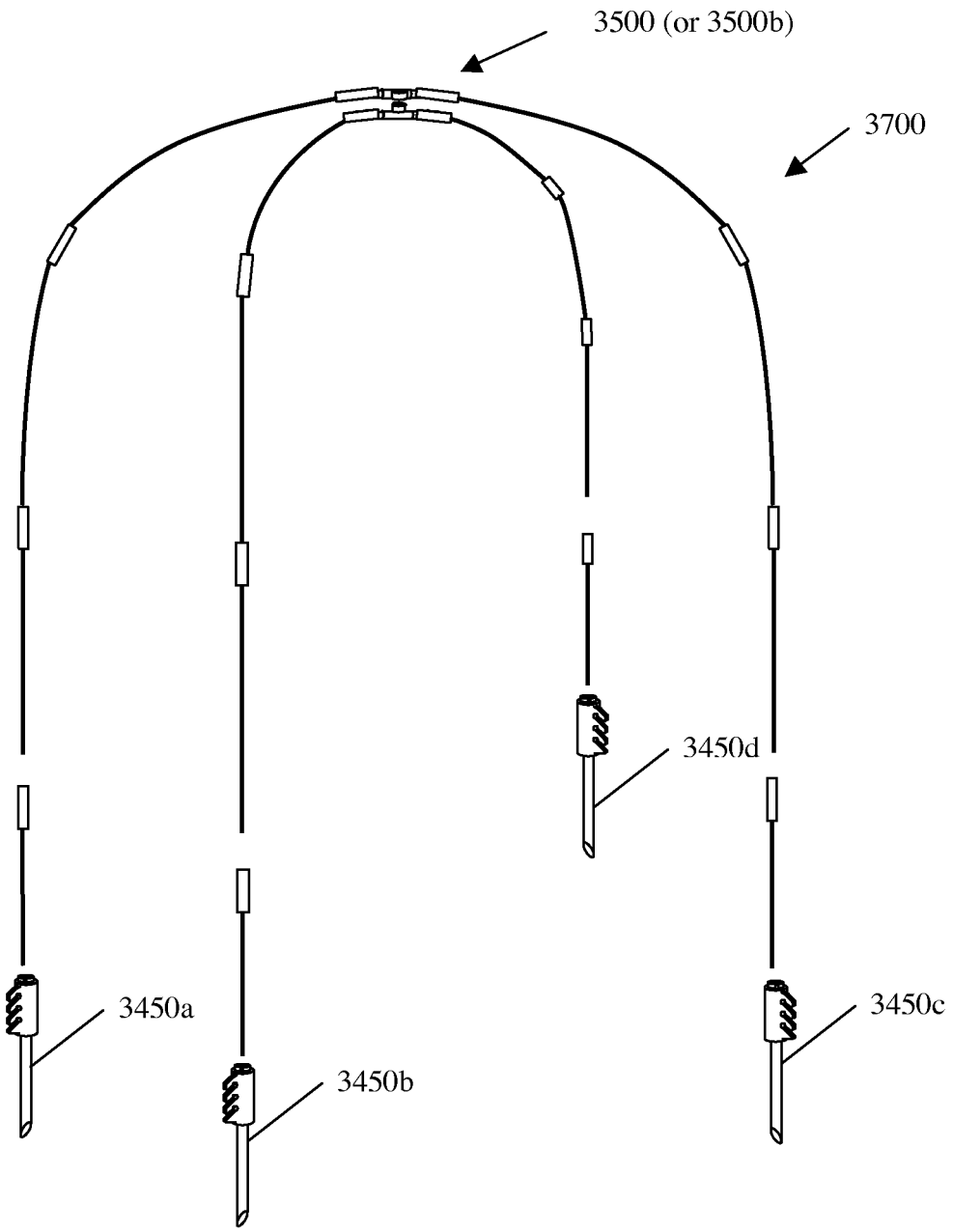

FIG. 8B shows the pair of pivoting arches 3700 configured with four stakes with cord clips 3450. In this configuration, the arches can be inserted into the ground and covered with a cover 1540 to form a shelter or blind (as shown in the parent applications). Cords attached to the cover 1540 are adjustably connected to the cord clips 3450.

Figure 8C:
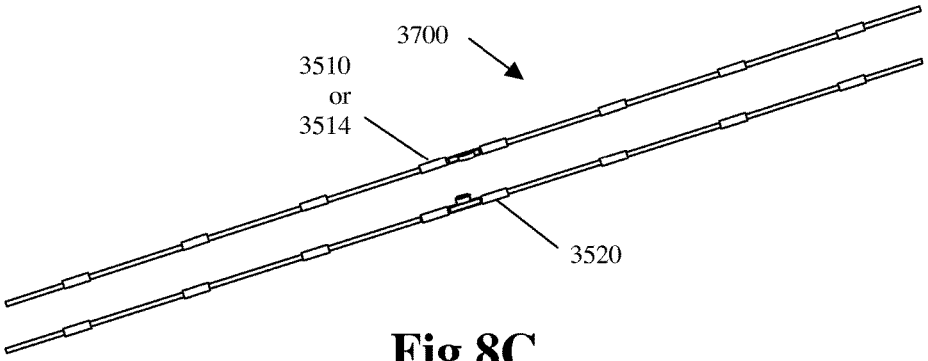
Figure 8D:
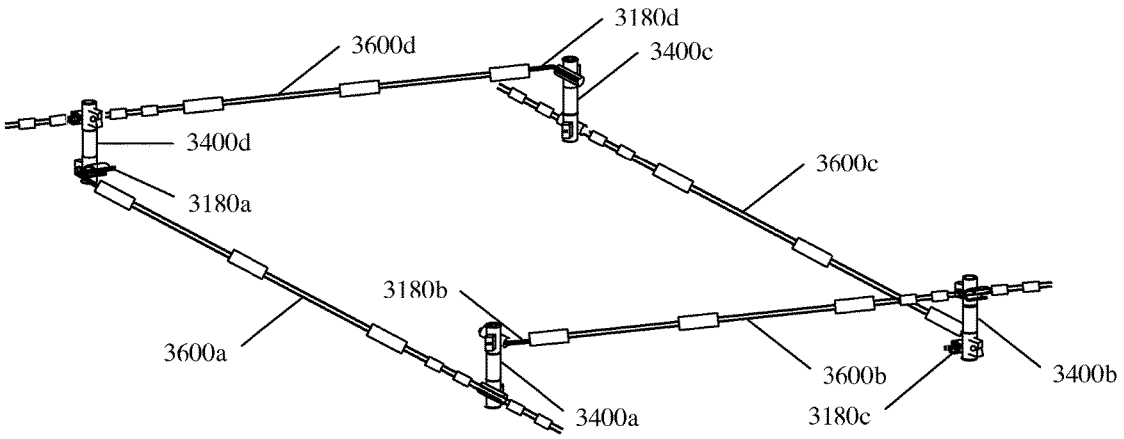
FIG. 8D shows one embodiment of a base structure.

FIG. 8C illustrates a pair of pivoting arches 3700 laying separated on the ground.

FIG. 8D illustrates a base structure configured with four base shafts. In this embodiment, each base segmented shaft 3600 is attached to a dual swivel clip 3400 via a banded support 3180, and is attached on the other end with a pole clip (as shown in FIG. 7D). Other embodiments can be formed using base segmented shafts connected as shown in FIG. 5Y, FIG. 6A and FIG. 7A.

A free standing structure is configured by creating a base, such as, for example, the base shown in FIG. 8D and then attaching the pair of pivoting arches 3700, as shown in FIG. 8A or FIG. 8C. Other base structures can be formed using different corner connectors such as those shown in FIG. 4A and FIG. 4B; FIG. 4X and FIG. 4Y; FIG. 5F; FIG. 5G; FIG. 5I; FIG. 5J and FIG. 5K; FIG. 5L and FIG. 5M; FIG. 5O; FIG. 5W; FIG. 5X; or FIG. 5Z.

Figure 8E:
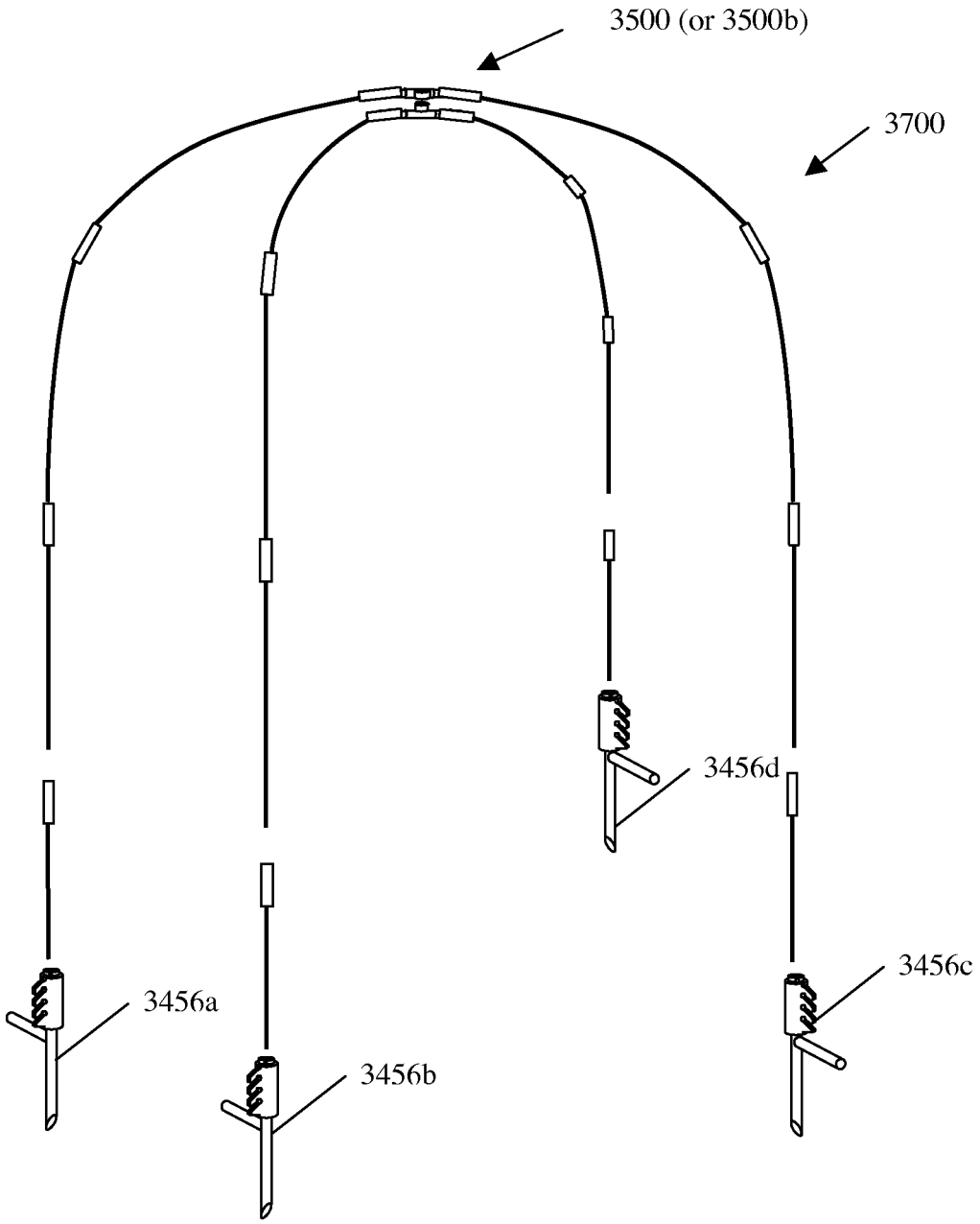

FIG. 8E shows the pair of pivoting arches 3700 preferably configured with four stakes with cord clips and leg 3456. In this configuration, the arches can be inserted into the ground and covered with a cover 1540 to form a shelter or blind (as shown in the parent applications). Cords attached to the cover 1540 are adjustably connected to the cord clips 3450. The legs on the stakes 3456 can be used to force the stakes 3456 into the ground and to remove the stakes from the ground.

Figure 8F:
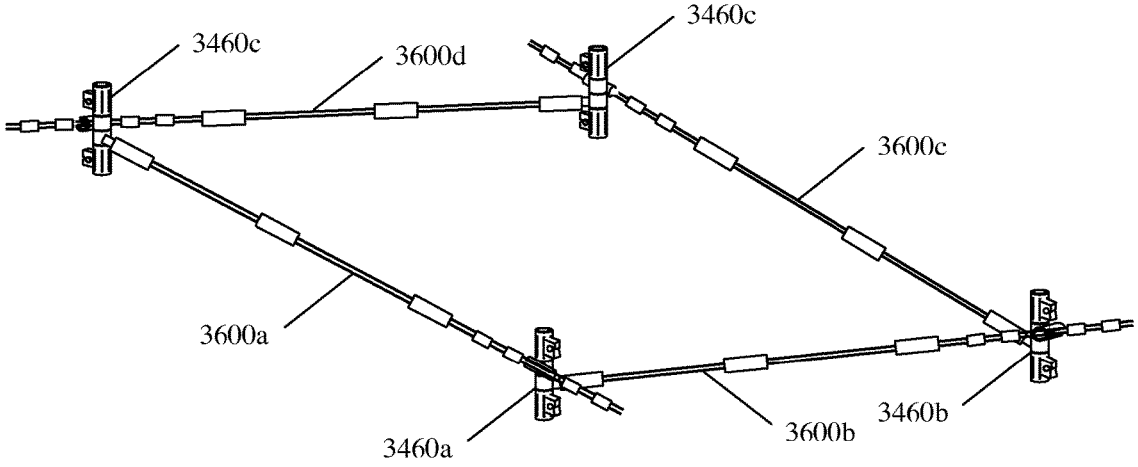
FIG. 8F illustrates a base structure configured with four base shafts and alternate dual-swivel clips.

FIG. 8F illustrates a base structure configured with four base shafts. In this embodiment, each base segmented shaft 3600 is attached to an alternate dual-swivel clip 3460. One end of the base segmented shaft 3600 is connected to an inserting end and the other end is adjustably attached to a pole clip 3410.

Figure 8G:
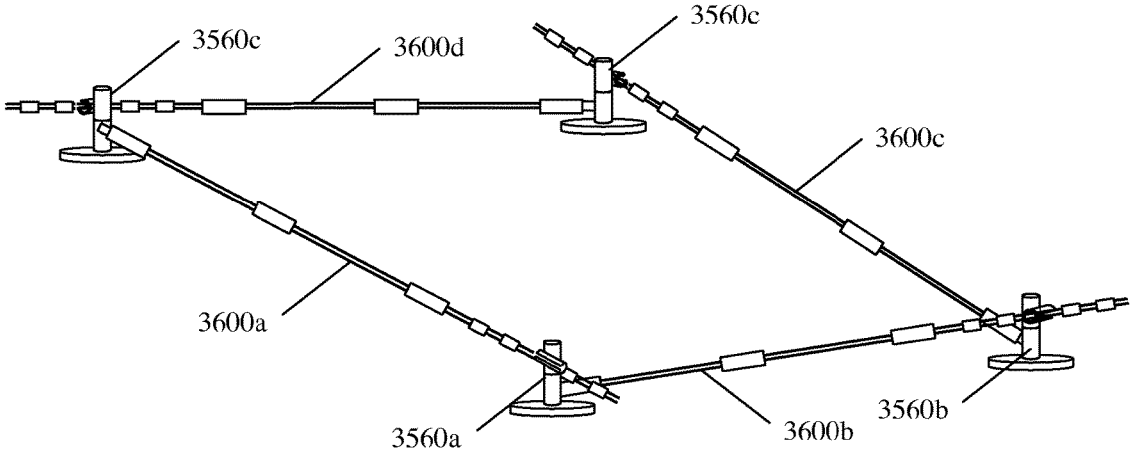
FIG. 8G illustrates a base structure configured with four base shafts and dual-universal clip bases.

FIG. 8G illustrates a base structure configured with four base shafts. In this embodiment, each base segmented shaft 3600 is attached to a dual-universal clip base 3560. One end of the base segmented shaft 3600 is connected to an inserting end and the other end is adjustably attached to a pole clip 3410.

Other Uses

While the descriptions of the various embodiments have been made in reference to blinds and shelters, the modular system of the present invention could also be used for other structures such as green houses and back yard mazes.

Lengths in Multiples and Integrated Features

The present invention anticipates that the various components will be provided in an integrated fashion. For example, shafts segments all are either the same size or are multiples of a standard unit of length. For example, in the currently preferred embodiment, the standard full-length is about 27 inches and a half stick is about 13.5 inches. All the components of an embodiment of a pole system will have corresponding configuration attachment means. Different connectors will be available to connect the shafts to configure various structures. Applying these principles allows the users of the system to configure an unlimited number of different structures to meet the needs of various situations and various sized groups.

Advantages

Modular

The system of the present invention is modular. A user can begin using a small number of components with minimal investment and add more pieces or more complex components later. A group of users can each own separate components, which are used independently, and then construct more complex configurations when the group comes together. The same component can be used to construct a variety of structures.

Separately Packable

Because the various components can be separated, different users in a group can carry a relatively lighter load, for example, in their backpacks.

Simple

The present invention is simple to make and use. Each component is easily made. The present invention requires little time to attach and to set up.

Easy to Use

The present invention is easy to use. To install, the operator simply attaches the shafts and connectors for the desired configuration. The structure can further include various curtains, panels, and covers (as shown in the parent applications).

Unlike conventional tents, or other complex blind systems, the user can simply place supports in the ground or alternatively build a base structure for a free standing structure. A structure can be assembled from shafts that can be preconfigured and quickly deployed.

Lightweight

The present invention comprises a few simple parts that can easily be constructed of lightweight materials. Being lightweight is important for those who have to carry gear into the outdoors.

Compact

The present invention is compact. The supports, shafts, and connectors can easily be held together into a small bundle or placed in a slender sack. This is advantageous for both storage and carrying.

Portable

The present invention is lightweight and compact allowing it to be carried long distances into the outdoors and to be used in a variety of locations. Components can be separately packable by a group of users.

Universal

The modular system of the present invention uses the same brackets, shafts, and connectors to construct a variety of structures. The same parts and equipment can be used to construct configurations for different purposes and for different environments. This maximizes the user's investment in the materials and minimizes the number of items to be packed. The use of standard shaft segments and half-length extension shafts provide for a large number of configurations using the same basic components.

Lower Cost, Longer Reliability

The present invention provides a number of novel features that reduce the complexity and cost of manufacture and that increase the reliability of the parts.

CONCLUSION, RAMIFICATION, AND SCOPE

Accordingly, the reader will see that the present invention provides easy to use, reliable, easy to repair, universal, simple, lightweight, compact, portable, multi-use modular system of poles and interconnections.

While the above descriptions contain several specifics these should not be construed as limitations on the scope of the invention, but rather as examples of some of the preferred embodiments thereof. Many other variations are possible. The various components could be used without departing from the scope and spirit of the novel features of the present invention.

Accordingly, the scope of the invention should be determined not by the illustrated embodiments, but by the appended claims and their legal equivalents.

The invention claimed is:

1. A modular system comprising a plurality of shaft segments, wherein each shaft segment comprises a unitary shaft, an inserting end, and a receiving end, wherein each one of a group of the inserting end and the receiving end has a partially enclosed channel, wherein when the inserting end has a partially enclosed channel, the receiving end has a protrusion, and when receiving end has a partially enclosed channel, the inserting end has the protrusion, wherein the protrusion is configured to connect with a corresponding partially enclosed channel of another shaft segment to form a configuration attachment, wherein said partially enclosed channel has a predetermined channel width, wherein said partially enclosed channel has a narrow neck which locks said protrusion in said channel, the narrow neck having a predetermined neck width which is less than the channel width, wherein the narrow neck increases the amount of force required for the protrusion to pass through the channel, wherein the inserting end is inserted into the receiving end and said protrusion is passed past said narrow neck to lock the configuration attachment, and wherein the shaft segments are configurable into a plurality of segmented shafts, each segmented shaft comprising a plurality of shaft segments coupled together by having the inserting end of one shaft segment removably coupled with the corresponding receiving end of another shaft segment to form the segmented shafts, wherein each shaft segment makes the configuration attachment comprising the protrusion of each shaft segment being removably attached to the partially enclosed channel of another shaft segment, and wherein each shaft segment further comprises a separate breakdown attachment comprising an elastic cord permanently connected between each unitary shaft and each receiving end formed within each shaft segment wherein each segmented shaft is altered at the breakdown attachment without fully detaching the configuration attachment, whereby the plurality of segmented shafts provide a support structure, and whereby the support structure is broken down by altering the breakdown attachments while maintaining the configuration attachments.

2. The system of claim 1, wherein said protrusion is on the inserting end and said corresponding partially enclosed channel is formed in the receiving end.

3. The system of claim 1, wherein said protrusion is on the receiving end and said corresponding partially enclosed channel is formed in the inserting end.

4. The system of claim 1, wherein the breakdown attachment comprises an additional inserting end and an additional receiving end, wherein one of a second group of the additional inserting end and the additional receiving end further comprises a protrusion and the other end of the second group comprises a corresponding second partially enclosed channel, whereby the breakdown attachment is locked to provide tensile strength or to control which breakdown attachments in a segmented shaft may be altered.

5. The system of claim 4, wherein:

a) the unitary shaft comprises a hollow shaft, b) the receiving end of at least one shaft segment comprises a hollow connector which fits over and receives said hollow shaft, and c) the breakdown attachment comprises:

i) the elastic cord passing through the hollow shaft between the ends of the shaft segment, ii) a cord retainer held near the center of the hollow connector, and iii) a cord attachment wherein one end of the elastic cord is permanently attached to the cord retainer, whereby the shaft segment is altered at the breakdown attachment by pulling the hollow shaft and the hollow connector apart and folding them at an angle so that the hollow shaft is no longer inside the hollow connector but is only held together by the cord.

6. The system of claim 1, further comprising a plurality of stakes, each stake having a receiving end, configured to received one of the inserting ends of one of the plurality of shaft segments, whereby a plurality of stakes are used to stake the system to the ground.

7. The system of claim 1, wherein said system further comprises at least one connector, wherein the at least one connector is separate and distinct from any of the shaft segments, wherein at least one shaft segment is removably attached to the at least one connector using one of said group of the inserting end and the receiving end.

8. The system of claim 1, further comprising a 4-way connector, having four connector ends connected together, each connector end having at least one connector end protrusion, wherein the 4-way connector is separate and distinct from any of the shaft segments, wherein each connector end protrusion connects with a corresponding partially enclosed channel on one of the shaft segments, whereby four corresponding shaft segments ends are connected to the 4-way connector.

9. The system of claim 1, wherein the inserting end further comprises an indicator that is visible when the inserting end is fully inserted into the receiving end so that the rotational position of the protrusion in relation to the narrow neck of the channel is assessed.

10. The system of claim 1, wherein at least two of the plurality of shaft segments have lengths which are a first predetermined length, and wherein at least one of the plurality of shaft segments has a second length which is half of the first predetermined length, forming a half-length shaft segment.

11. The system of claim 10 wherein the first predetermined length is about 27 inches.

12. A modular system comprising a plurality of shaft segments, wherein each shaft segment comprises a unitary shaft, an inserting end, and a receiving end, wherein each inserting end has a partially enclosed channel, wherein each receiving end has an inward protrusion which is configured to connect with a corresponding slot in a partially enclosed channel of another shaft segment to form a configuration attachment, wherein said partially enclosed channel has a predetermined channel width, wherein said partially enclosed channel has a narrow neck which locks said protrusion in said channel, the narrow neck having a predetermined neck width which is less than the channel width, wherein the narrow neck increases the amount of force required for the protrusion to pass through the channel, wherein the inserting end is inserted into the receiving end and said protrusion is passed past said narrow neck to lock the configuration attachment, and wherein the shaft segments are configurable into a plurality of segmented shafts, each segmented shaft comprising a plurality of shaft segments coupled together by having the inserting end of one shaft segment removably coupled with the corresponding receiving end of another shaft segment to form the segmented shafts, wherein each shaft segment makes the configuration attachment comprising the protrusion of each shaft segment being removably attached to the partially enclosed channel of another shaft segment, and wherein each shaft segment further comprises a separate breakdown attachment comprising an elastic cord permanently connected between each unitary shaft and each receiving end formed within each shaft segment wherein each segmented shaft is altered at the breakdown attachment without fully detaching the configuration attachment, whereby the plurality of segmented shafts to provide a support structure, and whereby the support structure is broken down by altering the breakdown attachments while maintaining the configuration attachments.

13. The system of claim 9, wherein said inward protrusion is hemispherical.

14. The system of claim 9, wherein said inward protrusion is pyramidal.

15. The system of claim 12, wherein at least one inserting end comprises a sleeve connected over a tip of the unitary shaft comprising at least one shaft segment, wherein said sleeve has an inside diameter which is substantially the same as the outside diameter of the unitary shaft, the unitary shaft having a consistent diameter along its entire length, wherein said sleeve has an outside diameter which is smaller than the inside diameter of a corresponding receiving end of another shaft segment, wherein said sleeve protects said tip from direct contact with other objects, and wherein said sleeve separates said unitary shaft from the corresponding receiving end and protects said unitary shaft from damage from said receiving end.

16. A modular system comprising a plurality of shaft segments, wherein each shaft segment comprises a unitary shaft, an inserting end, and a receiving end, wherein each one of a group of the inserting end and the receiving end has a partially enclosed channel, wherein when the inserting end has a partially enclosed channel, the receiving end has a protrusion, and when receiving end has a partially enclosed channel, the inserting end has the protrusion, wherein the protrusion is configured to connect with a corresponding partially enclosed channel of another shaft segment to form a configuration attachment, wherein said partially enclosed channel has a predetermined channel width, wherein said partially enclosed channel has a narrow neck which locks said protrusion in said channel, the narrow neck having a predetermined neck width which is less than the channel width, wherein the narrow neck increases the amount of force required for the protrusion to pass through the channel, wherein the inserting end is inserted into the receiving end and said protrusion is passed past said narrow neck to lock the configuration attachment, wherein the shaft segments are configurable into a plurality of segmented shafts, each segmented shaft comprising a plurality of shaft segments coupled together by having the inserting end of one shaft segment removably coupled with the corresponding receiving end of another shaft segment to form the segmented shafts, wherein at least one inserting end comprises a sleeve connected over a tip of the unitary shaft comprising at least one shaft segment, wherein said sleeve has an inside diameter which is substantially the same as the outside diameter of the unitary shaft, the unitary shaft having a consistent diameter along its entire length, wherein said sleeve has an outside diameter which is smaller than the inside diameter of a corresponding receiving end of another shaft segment, wherein said sleeve protects said tip from direct contact with other objects, and wherein said sleeve separates said unitary shaft from the corresponding receiving end and protects said unitary shaft from damage from said receiving end.

17. The system of claim 16, wherein at least one said protrusion is formed in said sleeve, and wherein said sleeve is permanently attached to said shaft.

18. The system of claim 16, wherein the unitary shaft comprises a hollow shaft, and wherein said sleeve further comprises a cord opening, whereby a cord may pass through said sleeve and said hollow shaft.

* * * * *